US009945200B2

(12) United States Patent
Travis et al.

(10) Patent No.: US 9,945,200 B2
(45) Date of Patent: Apr. 17, 2018

(54) CARTRIDGE VALVE ASSEMBLY FOR WELLHEAD

(71) Applicant: Weatherford/Lamb, Inc., Houston, TX (US)

(72) Inventors: Todd Travis, Humble, TX (US); Brandon M. Cain, Houston, TX (US); Eric Calzoncinth, Baytown, TX (US); Michael D. Mosher, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 54 days.

(21) Appl. No.: 13/946,528

(22) Filed: Jul. 19, 2013

(65) Prior Publication Data

US 2014/0020906 A1 Jan. 23, 2014

Related U.S. Application Data

(60) Provisional application No. 61/674,020, filed on Jul. 20, 2012.

(51) Int. Cl.

| | |
|---|---|
| ***E21B 33/03*** | (2006.01) |
| ***E21B 34/02*** | (2006.01) |
| ***E21B 34/04*** | (2006.01) |

(52) U.S. Cl.

CPC ..... *E21B 33/03* (2013.01); *E21B 34/02* (2013.01); *E21B 34/04* (2013.01)

(58) Field of Classification Search

CPC ..... E21B 33/038; E21B 33/03; E21B 34/04; E21B 34/045; E21B 34/02

(Continued)

(56) References Cited

U.S. PATENT DOCUMENTS 3,068,896 A * 12/1962 Grove ..... E21B 34/02 137/269

4,607,701 A 8/1986 Gundersen (Continued)

FOREIGN PATENT DOCUMENTS

GB 2192921 A 1/1988

OTHER PUBLICATIONS

Weatherford, "Petroline Heavy-Duty Wireline Fishing Services," www.weatherford.com, (c) 2005-2006, brochure No. 247.01, 28 pages.

(Continued)

*Primary Examiner* — Matthew R Buck
*Assistant Examiner* — Patrick F Lambe
(74) *Attorney, Agent, or Firm* — Blank Rome LLP

(57) ABSTRACT

A modular assembly for a wellhead has a housing and a plurality of modular cartridges. The housing connects with a studded or flanged connection to the wellhead, which can have a tubing adapter, casing hanger, etc. The modular cartridges can interchangeably stack in the housing's internal pocket so that the bores of the stacked cartridges configure the through-bore of the assembly communicating the wellhead with external components, such as flow lines, capillary lines, etc. The modular cartridges include a spacer cartridge, a hanger cartridge, a valve cartridge, and a cross cartridge. The spacer cartridge can be used to space other cartridges in the internal pocket, and the hanger cartridge can be used to support capillary strings and/or velocity strings in the wellhead. The valve cartridges have valve elements that can be opened and closed by bonnets that affix externally to the housing. The cross cartridge can have one or more cross ports to divert the assembly's through-bore to additional flow components, such as flow lines, wing valves, chokes, and the like.

38 Claims, 29 Drawing Sheets

(58) Field of Classification Search
USPC ..... 166/345, 344, 338, 365, 368
See application file for complete search history.

(56) References Cited

U.S. PATENT DOCUMENTS

| | | | | |
|---|---|---|---|---|
| 4,767,145 | A | 8/1988 | Bullard | |
| 6,161,618 | A | 12/2000 | Parks et al. | |
| 6,176,316 | B1 | 1/2001 | Hart | |
| 6,227,301 | B1 | 5/2001 | Edwards et al. | |
| 6,378,613 | B1 | 4/2002 | Kent et al. | |
| 6,357,529 | B1 | 5/2002 | Kent et al. | |
| 6,851,478 | B2 | 2/2005 | Cornelssen et al. | |
| 7,275,591 | B2 | 10/2007 | Allen et al. | |
| 7,779,921 | B2 | 8/2010 | Cain et al. | |
| 8,011,436 | B2 | 9/2011 | Christie et al. | |
| 2001/0025658 | A1* | 10/2001 | Bartlett | 137/601.01 |
| 2003/0141072 | A1 | 7/2003 | Cove et al. | |
| 2008/0029271 | A1 | 2/2008 | Bolding et al. | |
| 2008/0169097 | A1 | 7/2008 | Bolding et al. | |
| 2009/0107685 | A1 | 4/2009 | Cain et al. | |
| 2009/0294131 | A1 | 12/2009 | Lewis | |
| 2009/0294134 | A1 | 12/2009 | Jones et al. | |
| 2010/0181075 | A1 | 7/2010 | Reynolds | |

OTHER PUBLICATIONS

Weatherford, "Transformer Wellhead System: Build efficiency," www.weatherford.com, (c) 2009, brochure No. 5020.01, 8 pages.

T3 Energy Services, "Wellhead & Production Systems: Surface Wellhead Equipment Catalog," www.t3energy.com, (c) 2009, 49 pages.

Delta Doha Corporation, "X-mas Trees," obtained from www.deltadoha.com/index.php/products/wellhead-system/x-mas-trees, generated on Jul. 18, 2013, 2 pages.

MSP/Drilex, Inc., "Wellhead and Christmas Tree," obtained from www.msp-drilex.com/product.html, generated on Jul. 18, 2013, 3 pages.

MSP/Drilex, Inc., "Products & Service: Solid Block Christmas Tree," (c) 2008-2010 obtained from www.msp-drilex.com.cn/?act=product&cid=24, generated on Jul. 18, 2012, 1 page.

First Office Action in counterpart Canadian Appl. 2,821,254, dated Nov. 25, 2014.

Search Report in counterpart EP Appl. 13177330, dated Sep. 30, 2014.

* cited by examiner

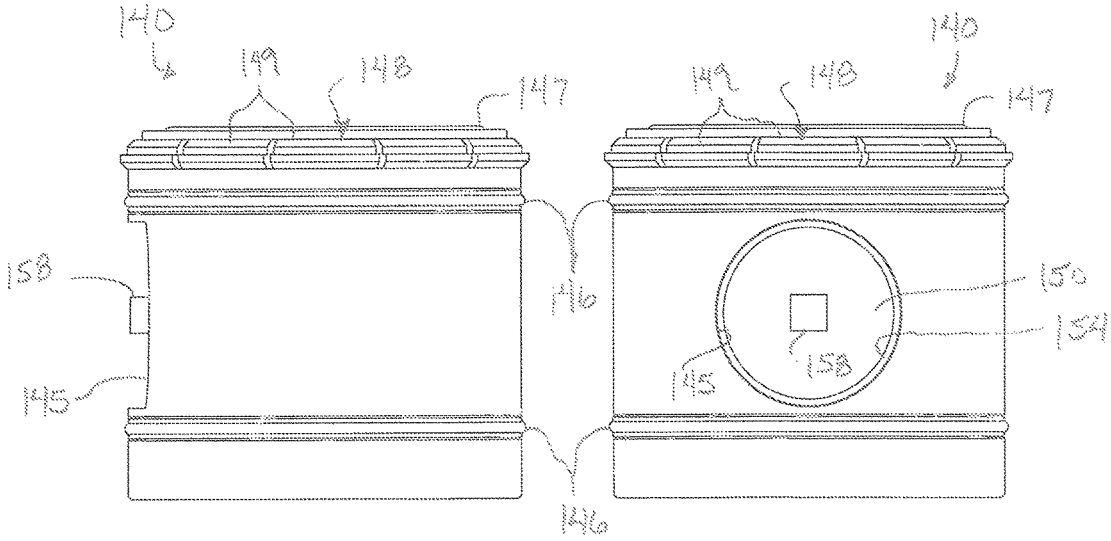
FIG. 11A
FIG. 11B
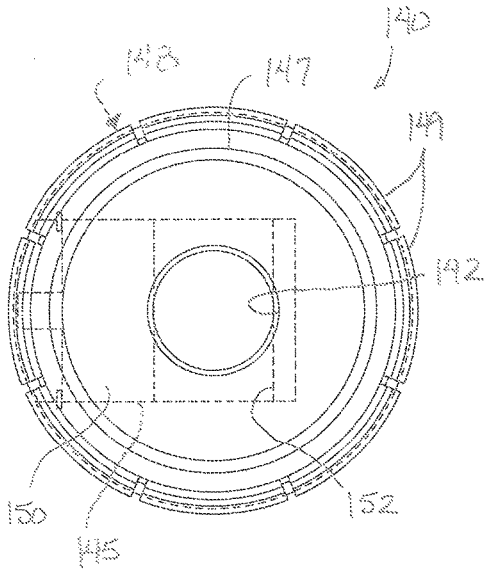
FIG. 11C
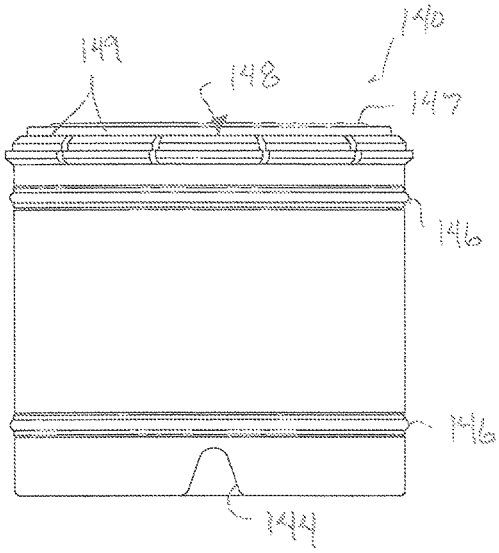
FIG. 11D

CARTRIDGE VALVE ASSEMBLY FOR WELLHEAD

CROSS-REFERENCE TO RELATED APPLICATIONS

This application claims the benefit of U.S. Prov. Appl. 61/674,020, filed 20 Jul. 2012, which is incorporated herein by reference in its entirety.

BACKGROUND OF THE DISCLOSURE

A production tree 10-1 of the prior art illustrated in FIG. 1 installs on a tubing head adapter 16 connected to a tubing head 12. Such a production tree 10-1 is often referred to as a Christmas tree. An upper master gate valve 20 connects above a lower master gate valve 18. A studded cross 22 mounts to the top of the upper master gate valve 18, and a top connector 14 connects to the top of the studded cross 22. As is typical, a flow line gate valve 24 and a kill line gate valve 26 connect to opposite sides of the studded cross 22, and the gate valves 24 and 26 connect to additional components (e.g., piping, chokes, etc.).

The master gate valves 18 and 20 can be closed to seal off the wellbore. The flow line gate valve 24 and the kill line gate valve 26 are used to control the flow line and kill lines (not shown). The top connector 14 can be removed to provide access to the wellbore for various operations. For example, a coil tubing assembly (not shown) or a wireline lubricator and valve assembly (not shown) can be positioned on the studded cross 22 in place of the top connector 14. Such accessory assemblies can be used to inject chemicals, to carry downhole sensors and tools, or to perform a variety of other operations.

Another assembly illustrated in FIG. 2 is a Y-body Christmas tree 10-2, such as disclosed in U.S. Pat. No. 6,851,478. The Y-body tree 10-2 has a body 30 formed as a single piece of steel that has a vertical bore 31 extending axially therethrough. The body 30 connects to a first shut-off valve 18 that is attached to a tubing head adapter 16 and a tubing head 12. The body 30 houses a second shut-off valve 32 for opening and closing the vertical bore 31. The body 30 also has gate valves 24 and 26 attached to an upper, flow tee portion 33 of the body 30 that communicates with the vertical bore 31. At the top of the vertical bore 31, the body 30 has a top cap 14 attached. A coil tubing bore 34 on the body 30 connects to the vertical bore 31 below the upper shut-off valve 32 in the body 30 and allows coil tubing CT to be inserted and suspended through the lower shut-off valve 18 and not the upper shut-off valve 32.

Yet another assembly illustrated in FIGS. 3A-3B is a Christmas tree 10-3 having integrated gate valves, such as disclosed in US 2008/0029271. In particular, a tubing head adapter 16 attaches to a tubing head 12, and an integral body 40 attaches to the tubing head adapter 16. A flow tee 22 attaches atop the integral body 40, and gate valves 24 and 26 and a top cap 14 attach to the flow tee 22 in a conventional manner.

The integral body 40 houses a lower shut-off valve 42 and an upper shut-off valve 44 therein. For instance, the integral body 40 depicted in cross-section in FIG. 3B is composed of a large block of material having the valves formed therein. As shown, such an integral body 40 can be used for a surface tree, but is often used for subsea trees too. Inside, the body 40 can house a coil tubing assembly 45 supported in bore 41 by lock down pins 46 and connected to a feed line 48 with a connector.

Similar to the tree 10-3 of FIGS. 3A-3B, another form of Christmas tree is a solid block tree that has a single, solid-forged body and integrated lower and upper master valves. This body also has integrated wing valves and a swab valve. Such a tree offers the advantage of being compact.

Each component of such trees 10 must be configured for the desired through-bore of the trees 10, and all of the flanged connections between components must be configured for the required pressure rating of the tree 10. This requires careful design of the tree and a necessary inventory of the components to build the tree 10 in the field. In general, what is needed in the art are production trees that are more versatile in both design and assembly.

SUMMARY OF THE DISCLOSURE

A modular tree assembly for a wellhead has a housing and a plurality of modular cartridges. The housing connects with a studded or flanged connection to the wellhead, which can have a tubing adapter, tubing head, etc. The modular cartridges interchangeably stack in the housing's internal pocket. The modular cartridges form a through-bore of the assembly communicating with the wellhead and configure the assembly in an operational arrangement.

In general, the operational arrangement of the assembly can include one or more of: a lower master valve, an upper master valve, a swab valve, a cross tee, a capillary hanger, and a tubing hanger. The modular cartridges can include one or more of a spacer cartridge, a hanger cartridge, a valve cartridge, and a cross cartridge in a desired operational arrangement. The bores of the stacked cartridges form the through-bore of the assembly communicating the wellhead with external components, such as flow lines, capillary lines, etc. Internal features and components of the modular cartridges configure the assembly for operation as a production tree or for other wellhead operation.

The spacer cartridge can be used to space other cartridges in the internal pocket, and the hanger cartridge can be used to support capillary strings, velocity strings, and/or tubing strings in the wellhead. The valve cartridges have valve elements that can be opened and closed by bonnets that affix externally to the housing to open or close the through-bore of the assembly during an emergency, maintenance, or the like. The cross cartridge can have one or more cross passages to divert the assembly's through-bore to additional flow components, such as flow lines, wing valves, chokes, and the like.

The foregoing summary is not intended to summarize each potential embodiment or every aspect of the present disclosure.

BRIEF DESCRIPTION OF THE DRAWINGS

FIGS. 10A-1 and 10A-2 illustrate side and end sectional views of another tree assembly according to the present disclosure.

FIGS. 10B-1 and 10B-2 illustrate side and end sectional views of yet another tree assembly according to the present disclosure.

FIGS. 11A-11D illustrates side, front, top, and back views of a valve cartridge for the disclosed tree assembly.

DETAILED DESCRIPTION OF THE DISCLOSURE

A. Modular Production Tree Assembly

Figure 5A:
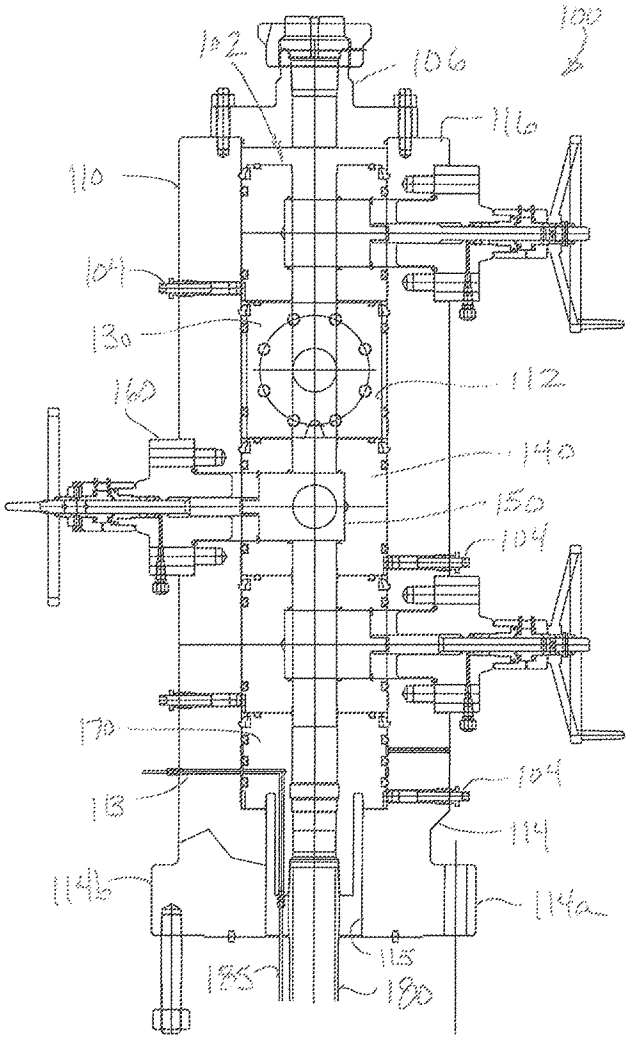
FIGS. 5A-5C illustrate side-sectional views of the tree assembly according to the present disclosure in another arrangement.
Figure 4A:
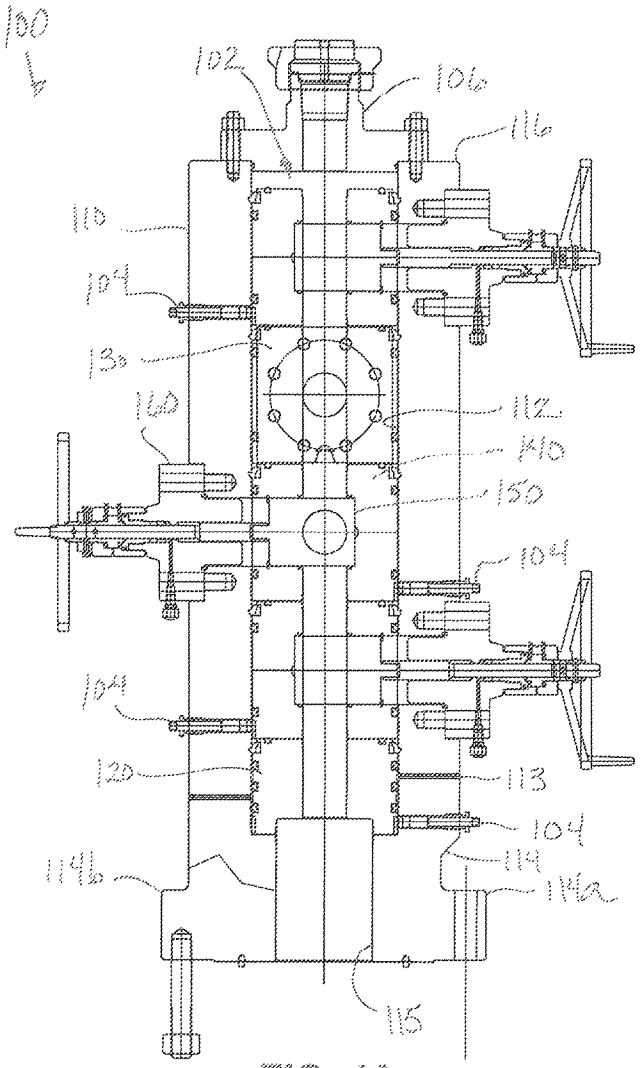
FIGS. 4A-4C illustrate side-sectional views of a tree assembly according to the present disclosure in one arrangement.
Figure 4B:
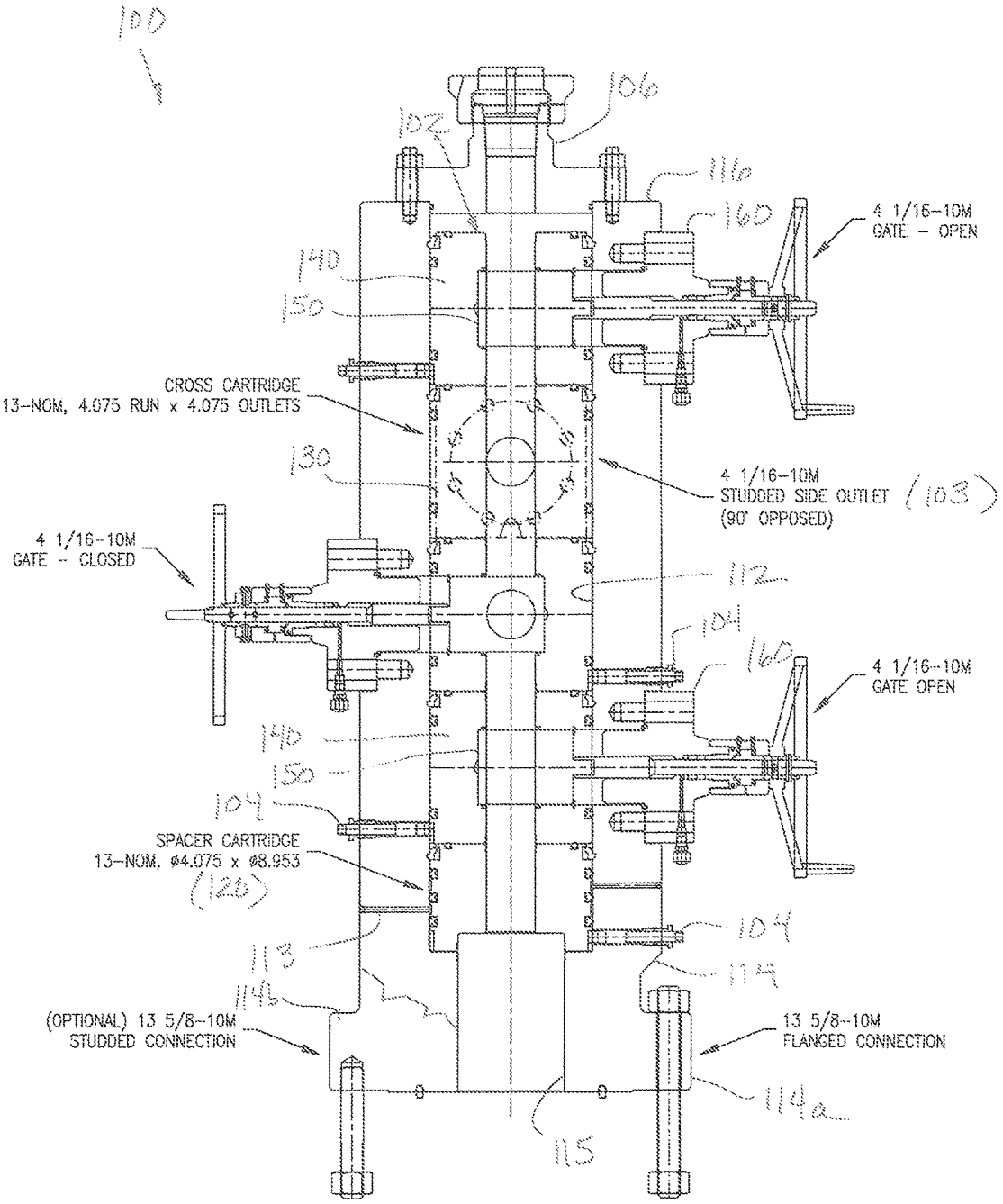
Figure 5B:
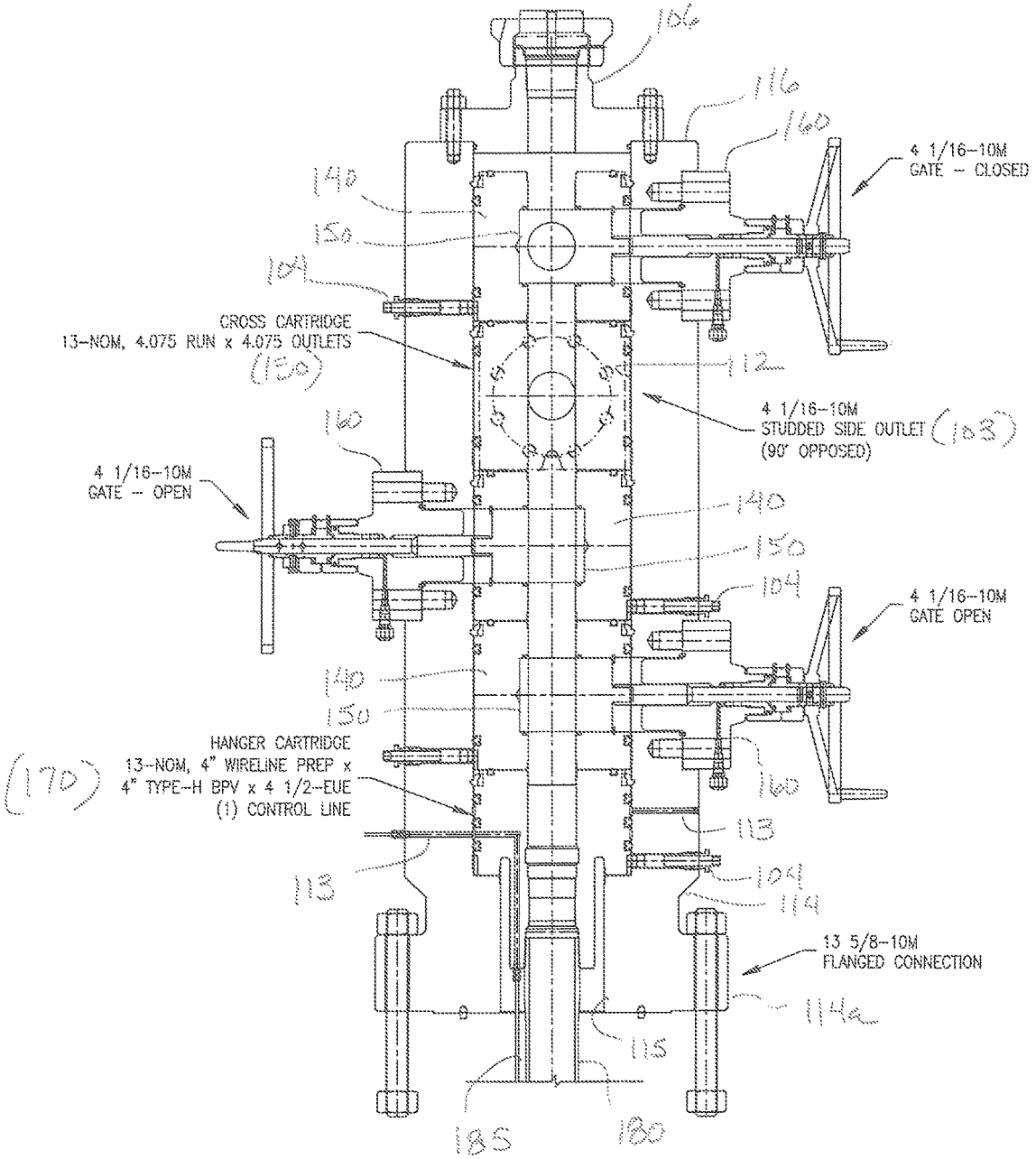
Figure 4C:
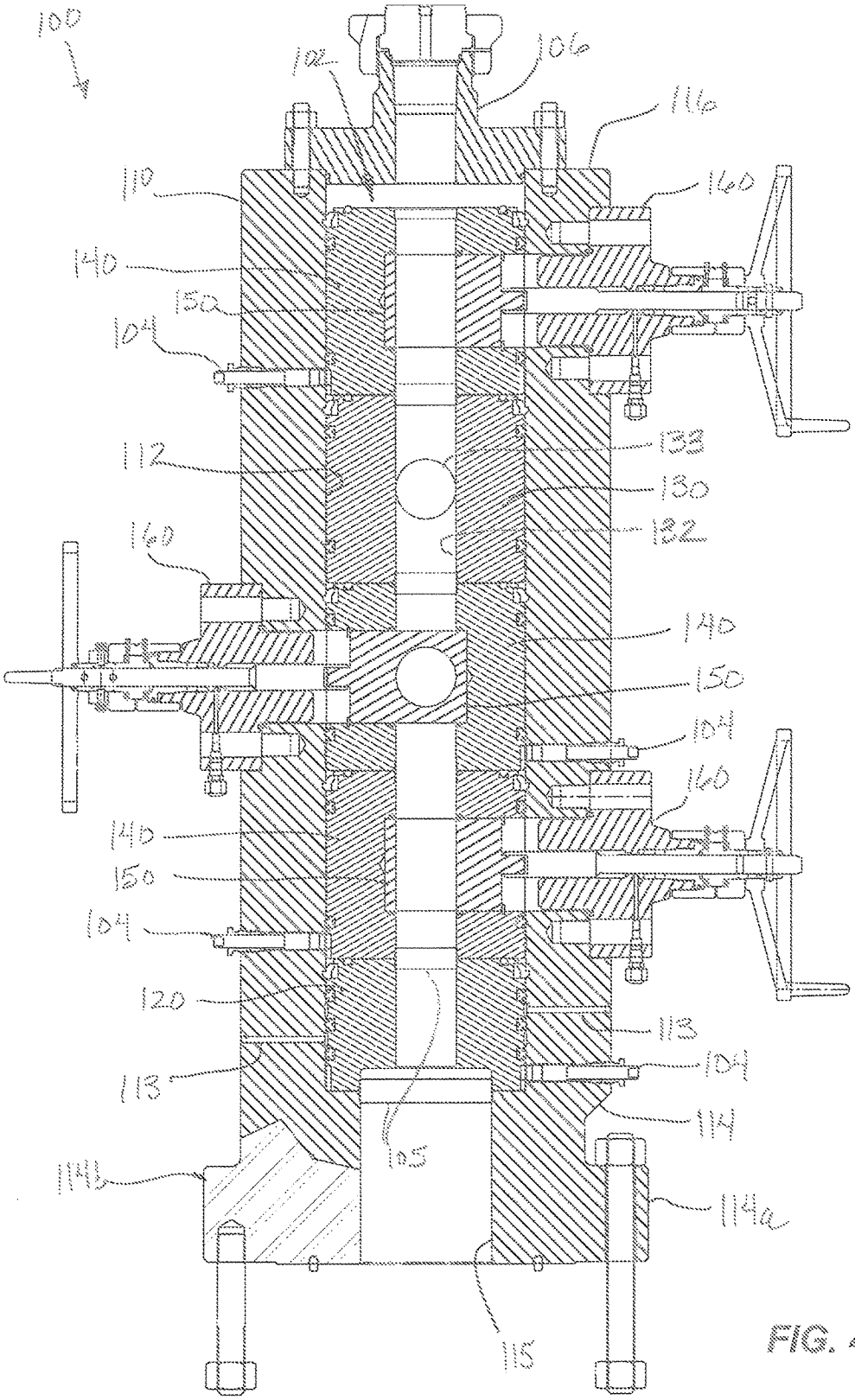
Figure 5C:
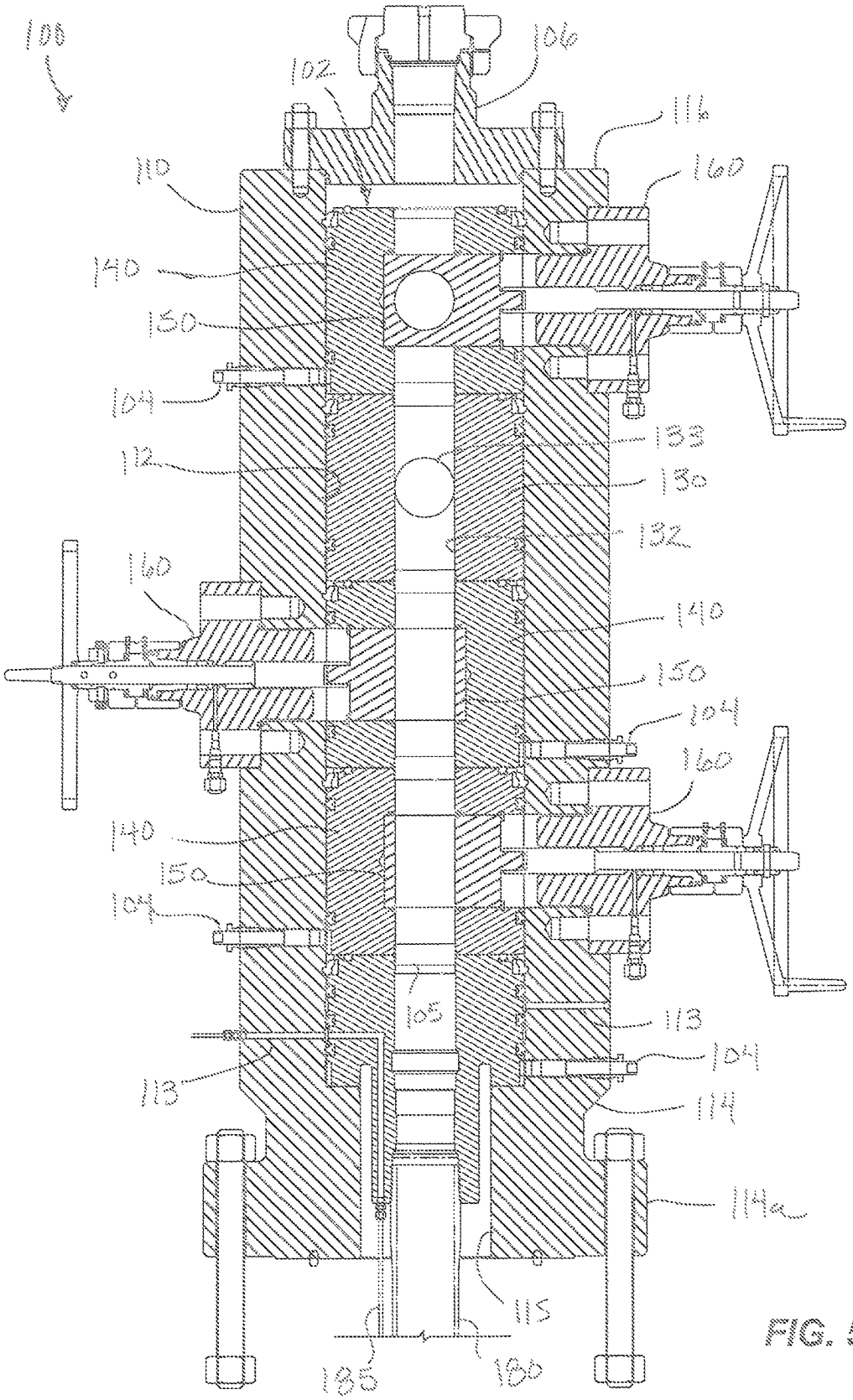

FIGS. 4A-4C illustrate side-sectional views of a production tree assembly 100 according to the present disclosure in one arrangement. In similar views, FIGS. 5A-5C illustrate the tree assembly 100 in another arrangement. The tree assembly 100 includes a housing or vessel 110 that connects atop a tubing head adapter (not shown), a tubing head (not shown), and/or any other conventional components of a wellhead known in the art. Internally, the housing 110 defines an internal pocket 112 disposed from a top end 116 to a bottom end 114. The inner dimension of the pocket 112 can be uniform from the top end 116 down. Toward the housing's bottom end 114, however, the housing 110 has a bore opening 115 that communicates with the wellhead (not shown) and may be narrower than the pocket 112.

Also internally, any desired arrangement of modular cartridges or cassettes (e.g., 120, 130, 140, . . . ) stack in the internal pocket 112 to make up the assembly's internal bore 102, cross tee flow paths, single tee flow paths, valves, hangers, and the like. In particular, one or more independent, interchangeable cartridges (e.g., 120, 130, 140, . . . ) dispose inside the internal pocket 112 of the housing 110. Which particular cartridges (e.g., 120, 130, 140, . . . ) and how those cartridges are arranged in the housing 110 can be configured to suit a particular implementation. Because the assembly 100 is internally configurable, it is more versatile than a conventional block tree, which is preconfigured in how it is arranged and what through-bore and flow paths it has.

Toward the top end 116, a top connector 106 affixes to the housing 110 to close the internal pocket 112. This top connector 106 can be used to seal the housing 110, to hold a gauge valve and pressure gauge (not shown), to receive components for capillary or coiled tubing (not shown), to hold a wireline lubricator and other components (not shown), or to meet any of the other various purposes for the tree assembly 100. The top end 116 can have a studded connection as shown or may have a flanged or other type of connection.

Although the top connector 106 is shown affixed to the top end 116, any suitable components for a tree assembly may connect to the top end 116. Moreover, another housing 110 for holding interchangeable, modular cartridges (120, 130, 140, 170, . . . ) can connect to the top end 116 to extend the tree assembly 100.

In the example of FIGS. 4A-4C, the cartridges shown include a spacer cartridge 120, a cross cartridge 130, and multiple valve cartridges 140. FIGS. 5A-5C show the assembly 100 with a hanger cartridge 170 rather than a spacer cartridge (120). Other possible cartridges for the tree assembly 100 include cartridges for capillaries, monitor lines, injection lines, control lines, electrical penetration, fiber optic lines, and sensor lines.

In the assemblies 100 of FIGS. 4A-4C and 5A-5C, the multiple valve cartridges 140 are arranged as a lower master valve and an upper master valve (arranged atop one another) and as a swab valve (disposed above the cross cartridge 130). The cross passages 133 of the cross cartridge 130 can connect to wing valves (not shown) for flow and kill lines, which are 90-degrees offset from the sectional views shown. This represents one of several typical configurations for a production tree.

In general, the assembly 100 can have any desired arrangement of valve cartridges, cross cartridges, hanger cartridges, and other cartridges as the implementation requires. Moreover, the assembly 100 can be used for surface or subsea applications and may meet the American Petroleum Institute Specification 6A, 17D, or other. Furthermore, the assembly 100 can be configured for normal production operations, water injections operations, thermal recovery operations, offshore operations, high pressure and anti-sulfide operations, and the like.

Externally, the assembly 100 has additional modular components. In particular, bonnets 160 affix to the housing 110 for operating the valves inside the valve cartridges 140 as described below. Additionally, alignment pins 104 dispose in side holes in the housing 110 to align the cartridges (120, 130, 140, 170, . . . ) in the housing's pocket 112. Other flanges, lock down pins, capillary connections, and external components can also be used as needed.

The cartridges (120, 130, 140, 170, . . . ) can set in place in the housing 110 using one or more locks. For example, lock down pins (not shown) as known in the art can dispose in side holes in the housing 110 to lock one, more, or all of the cartridges (120, 130, 140, 170, . . . ) in the housing's pocket 112. As shown and described later, however, each of the cartridges (120, 130, 140, 170 . . . ) can have a lock or latch ring to lock down the cartridges (120, 130, 140, 170 . . . ) in the pocket 112. Although it is preferred that each cartridge (120, 130, 140, 170 . . . ) has its own lock, this may not be strictly necessary in every implementation because upper cartridges with locks will tend to lock the lower cartridges in place in the housing 110.

Due to the requirements of such an assembly 100, the various components need to be rated for the same operating pressure, and those components communicating directly with the wellbore need to be sized for the particular tubing size. As expected, the assembly 100 composed of multiple components should be designed, arranged, and assembled to meet the required operating pressures and tubing size. The disclosed tree assembly 100 overcomes conventional difficulties encountered with prior art production trees. For example, the internal pocket 112 of the housing is given a predefined external size independent of the particular tubing size for the final assembly 100. In this way, the various cartridges (120, 130, 140, 170 . . . ) for use in the pocket 112 can have this predefined external size, which makes the disclosed assembly 100 versatile for various implementations.

In contrast to the similar external size, the cartridges (120, 130, 140, 170 . . . ) themselves can be configured with the appropriate internal bores for the desired tubing size of the given implementation. Thus, each of the various modular cartridges (120, 130, 140, 170 . . . ) to be used with the assembly 100 can each have a preconfigured bore therein so that a particular set of the cartridges with desired bore diameters can be used in the housing 110 to create the desired diameter of the assembly's through-bore 102. Another set of the cartridges with a different bore diameter can then be used in the housing 110 instead to create a different diameter of the assembly's through-bore 102.

In general, the internal pocket 112 can be cylindrical and can have a predefined diameter regardless of the pressure rating of the assembly 100 or the eventual diameter of the through-bore 102 of the assembly 100 made up of the bores of the various stacked cartridges (120, 130, 140, 170 . . . ). In this way, each of the various modular cartridges (120, 130, 140, 170 . . . ) to be used with the assembly 100 can each have the same outside dimension regardless of the housing 110 in which they are to be used.

Rather than being cylindrical, the internal pocket 112 can define other shapes, such as oval, polygon, or the like, limiting the orientations that the cartridges can dispose in the housing 110 and helping in their alignment. Additionally, the internal surface of the housing's pocket 112 and the external surfaces of the cartridges (120, 130, 140, 170 . . . ) can use a slot and key arrangement for orienting and aligning the cartridges in the housing 110.

Similar to the same or comparable outer dimensions, the modular cartridges (120, 130, 140, 170 . . . ) may have the same or comparable heights as one another so that they stack in a uniform manner inside the internal pocket 112. For example, the valve cartridges 140 used in a given assembly may each have the same height and would likely be identical to one another. The spacer cartridge 120 may have a comparable height to any of the various hanger cartridges 170 that could be used in the lower end of the internal pocket 112. In this way, modifying the assembly 100 to remove the spacer cartridge 120 and replace it with a hanger cartridge 170 will not alter the stack height of the cartridges (120, 130, 140, 170 . . . ) inside the housing 110, as depicted in the different arrangements of FIGS. 4A-4C and 5A-5C.

The cross cartridge 130 can also have a same stack height as the other cartridges, such as the valve cartridges 140. Yet, depending on the bore dimension in the cartridges and the side of the cross passages 133 in the cross cartridge 130, the height of the cross cartridge 130 may need to be greater than that required for the other cartridges.

At the bottom end 114, the housing's bore opening 115 may or may not be sized for a particular tubing size. Also at the bottom end, the housing 110 can have a flanged connection 114*a* (see e.g., right-side of FIGS. 4A-4C & 5A-5C), a studded connection 114*b* (see e.g., left-side of FIGS. 4A-4C & 5A-5C), or any other suitable connection. Either way, the connection of the bottom end 114 is configured for a particular operating pressure for the assembly 110. As such, the housing 110 may or may not be configured for a particular tubing size as the case may be, but the housing 110 can be rated for a particular operating pressure. In any event, the various cartridges (120, 130, 140, 170 . . . ) can be universal and can define specific internal bores, and the cartridges (120, 130, 140, 170 . . . ) of a given size can be used for this and other housings 110 rated for other operating pressures. In this way, the assembly 100 can be versatile and arranged as needed for an implementation.

For example, a specific implementation may require an operating pressure of 5-kpsi, 10-kpsi, 15-kpsi, or 20-kpsi and a bore diameter of anywhere from 2-in. to 7-in. Other implementations may require other operating pressures and bore diameters. To meet these requirements, a housing 110 can be selected with an appropriately sized bottom opening 115 suitable for the bore diameter and can be selected with a connection 114*a* or 114*b* rated for the designated operating pressure. The through-bore 102 can then be reconfigurable from one bore diameter to another by using different cartridges (120, 130, 140 . . . ) with selected bore diameters.

To complete the assembly 100, the arrangement of cartridges (120, 130, 140, 170 . . . ) with bores for the required bore size are selected and arranged for desired positioning in the housing 110. For example, the arrangement may use a spacer cartridge 120, two lower valve cartridges 140, a cross cartridge 130, and an upper valve cartridge 140 as in FIGS. 4A-4C. In another example, the arrangement may use a hanger cartridge 170, two lower valve cartridges 140, a cross cartridge 130, and an upper valve cartridge 140 as in FIGS. 5A-5C. These arrangements may be typical for a given implementation, but the cartridges (120, 130, 140, 170 . . . ) can be arranged as noted above in any desired arranged due to the universality of the cartridges (120, 130, 140, 170 . . . ).

Like the cartridges (120, 130, 140, 170 . . . ), the bonnets 160 can be universal and can be rated for a particular operating pressure. Therefore, a given bonnet 160 can be used on any housing 110 of any bore size, but the bonnet 160 may be rated for a particular operating pressure. Flanged connections rated for the particular operating pressure also affix to studded side outlets (103: FIGS. 4B and 5B) on the sides of the housing 110 to communicate the cross passages 133 in the cross cartridge 130 with additional components (e.g., wing valves, piping for flow and kill lines, chokes, etc.). Servicing of the assembly 100 can be performed through the openings 117 for the bonnets 160 and through the top end 116.

The housing 110, of course, has a selected arrangement of external openings for attachment of the bonnets 160, flow connections, alignment pins, capillaries, and the like. As noted above, for example, the cross cartridge 130 defines its central bore 132 and has one or more cross passages 133 that connect the bore 132 outside the cartridge 130. For example, opposing cross passages 133 may be provided as a cross tee to connect to opposing flow lines outside the housing 110. Other configurations can be used, such as one cross passage or more as may be needed. In any event, the housing 110 has studded openings 103 for affixing flow components to communicate with the cross passages 133 or for affixing sealed adapters to close off the openings 103. Also, as noted herein, the housing 110 has bonnet openings 117 for attachment of the bonnets 160 for the valve cartridges 140.

To accommodate a modular arrangement of cartridges, the housing 110 may have openings 103 and 117 that are not used for a flow component or a bonnet 160 in a given arrangement. In this case, the openings 103 and 117 can be closed by sealed adapters if the cross cartridge 130 lacks one of the cross passage 133, if one of the cross passages 133 is not to be used for flow, or if a valve cartridge 140 is not to be used at one of the bonnet openings 117.

For example, not all tree assemblies may use a swab valve above the cross cartridge 130 so that a valve cartridge 140 may not be used in the internal pocket 112 above the cross cartridge 130. Instead, a spacer cartridge 120 may be installed above the cross cartridge 130 instead of a valve cartridge 140 as shown. Since a valve cartridge 140 is not used, the bonnet opening 117 for this location on the housing 110 can be sealed with an appropriate adapter (not shown) that connects to the housing 110 at the opening 117 with a studded connection comparable to that used on the bonnets 160.

Figure 5D:
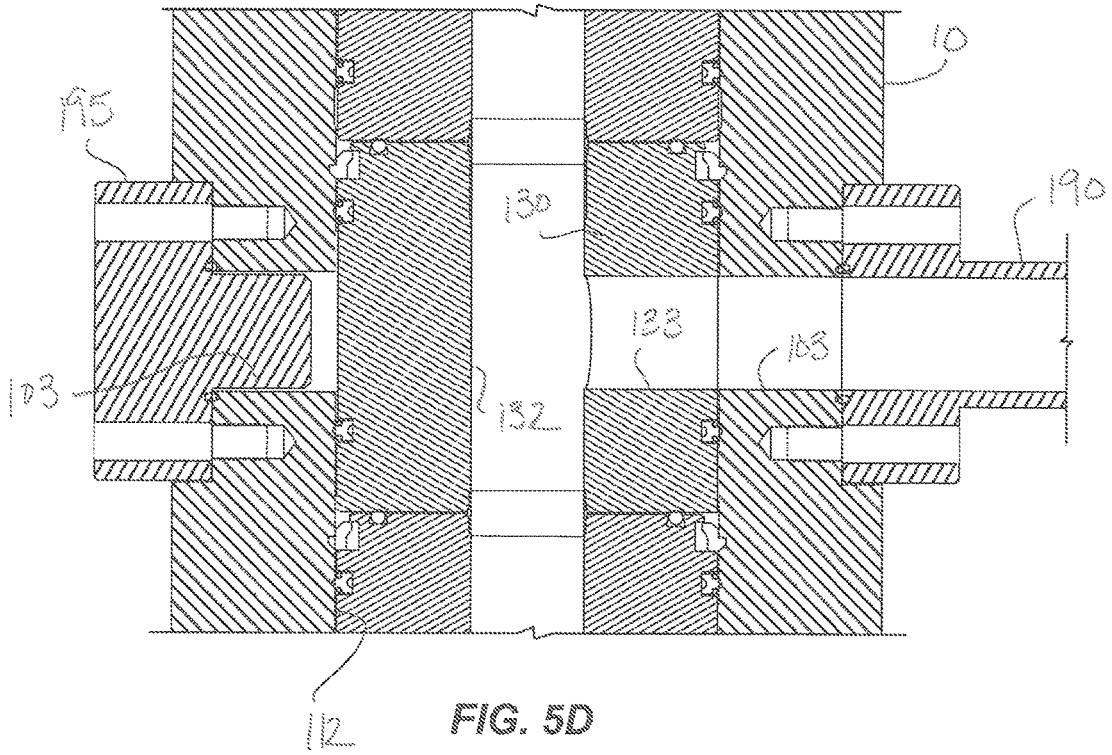
FIG. 5D illustrates a side-sectional view of a portion of the tree assembly showing a cross cartridge, sealed adapter, and flow component.

In another example, the housing 110 may have opposing flow openings 103, but the cross cartridge 130 may have only one cross passage 133 or only one of the cross passages 133 may be used for flow. In this case, the unused flow opening 103 for this location on the housing 110 can be sealed with an appropriate adapter (not shown) that connects to the housing 110 at the opening 103 with a studded connection. For example, FIG. 5D shows a sealed adapter 195, which can be a closed bonnet, flange, cap or the like, that can affix to an opening on the housing 110 in a similar fashion to other components disclosed herein. Here, the adapter 195 affixes to the studded side outlet 103 of the housing 110 when the cross cartridge 130 has only one cross passage 133 to communicate with an opposing studded outlet 103 and flow component 190.

B. Valve Cartridge and Bonnet

Figure 6A:
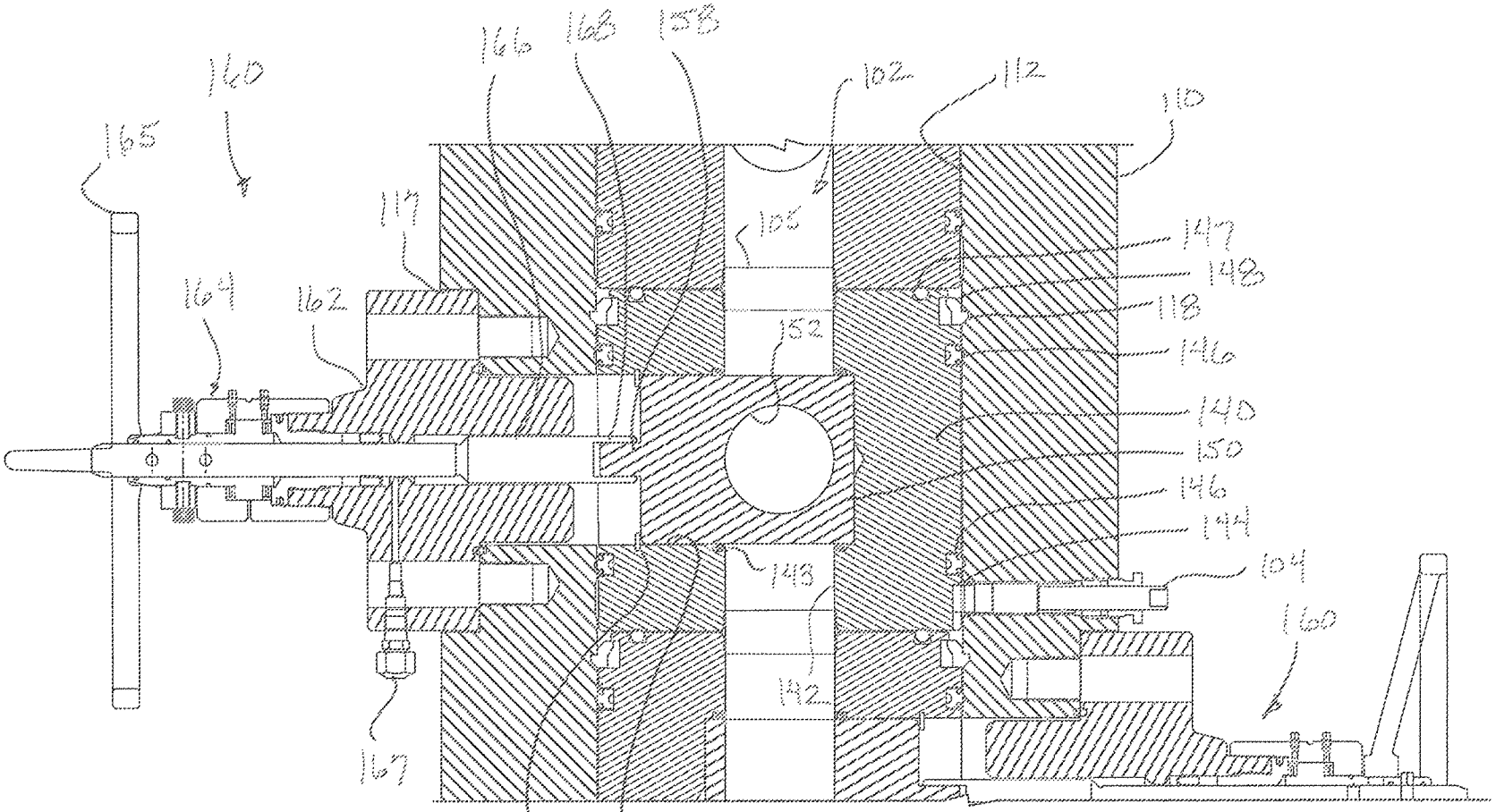
FIG. 6A illustrates a side-sectional view of a portion of the tree assembly showing a valve cartridge and a bonnet in detail.
Figure 6B:
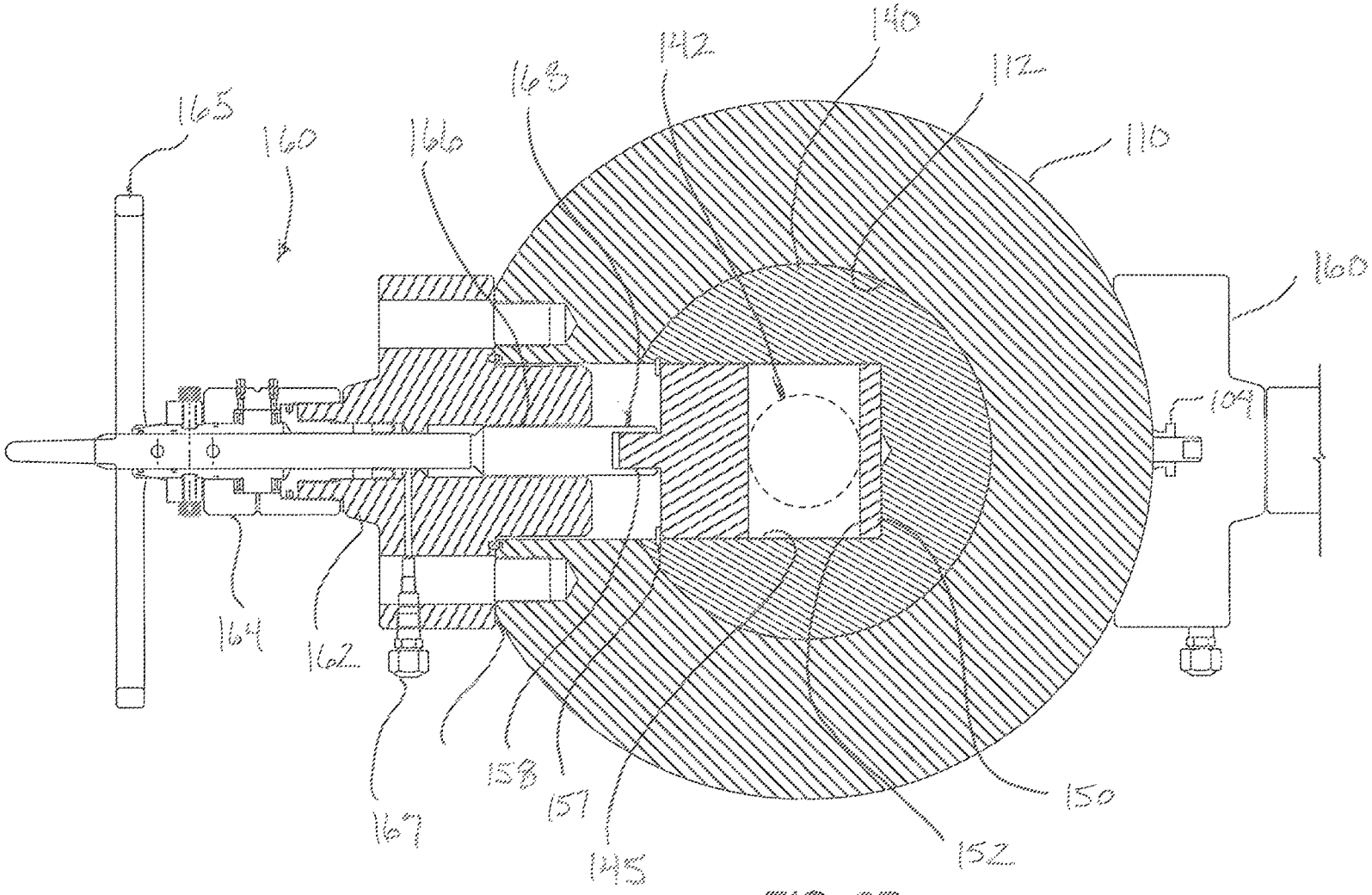
FIG. 6B illustrates an end-sectional view of the tree assembly showing a valve cartridge and a bonnet in detail.

As noted above, one particular type of cartridge or cassette for the assembly 100 is a valve cartridge 140. Turning then to FIG. 6A, a side-sectional view of a portion of the tree assembly 100 shows an embodiment of a valve cartridge 140 and a bonnet 160 in detail. For further reference, FIG. 6B shows the valve cartridge 140 and the bonnet 160 in an end-sectional view of the tree assembly 100.

The valve cartridge 140 installs in the housing's pocket 112 and includes a central bore 142, which will make up part of the assembly's through-bore 102. To seal inside the pocket 112, the cartridge 140 has upper and lower seals 146 disposed around the outside of the cartridge 140 toward the cartridge's upper and lower ends. These seals 146 can be any suitable type of seal for sealing the cartridge 140 in the internal pocket 112 of the housing 110. For example, the seals 146 can be metallic, elastomeric, or plastic and can be machined or molded. Moreover, the seals 146 can be spring energized, plastic injected, plastic energized, or wound.

For additional sealing, the top surface of the cartridge 140 can also have a gasket 147 that engages against the bottom surface of the cartridge (e.g., cross cartridge 130) disposed above the valve cartridge 140. Similar to the seals 146, this gasket 147 can be any suitable type of gasket for sealing interfacing surfaces of the stacked cartridges. For example, the gasket 147 can be metallic, elastomeric, or plastic and can be machined or molded. The gasket 147 can be spring energized, plastic injected, plastic energized, or wound.

To align the valve cartridge 140 in the pocket 112 so that it aligns properly with the housing's external opening 117, the lower edge of the valve cartridge 140 defines an alignment slot 144 that fits on an alignment pin 104 disposed in the housing 110. This can ensure that the cartridge 140 is properly oriented in the pocket 112 with the components of the cartridge 140 aligned with other components of the assembly 100 as discussed herein. As an alternative to an alignment pin 104, the top of the cartridge on which the valve cartridge 140 is stacked may have an alignment tab or other feature engaging the bottom of the valve cartridge 140 or an alignment slot 114 to align the two cartridges to one another, provided that one of the cartridges aligns properly in the housing 110.

The upper and lower ends of the cartridge's bore 142 can have internal bore seals 105 to seal with the bores of the adjacent cartridges. These bore seals 105 can be any suitable type of seal for sealing the interface between bores of the stacked cartridges and completing the assembly's through-bore 102. For example, the seals 105 can be metallic, elastomeric, or plastic and can be machined or molded. The seals 105 can be spring energized, plastic injected, plastic energized, or wound.

To lock the cartridge 140 down inside the pocket 112, a lock in the form of a latch ring 148 is disposed around the upper edge of the cartridge 140. Intrinsically biased or biased by spring elements (not shown), the latch ring 148 extends beyond the outer edge of the cartridge 140 to engage in a lock groove 118 defined inside the housing's pocket 112. When the cartridge 140 is inserted into the pocket 112, however, the latch ring 148 is biased inward and allows the cartridge 140 to be lowered into the pocket 112. Once in position in the pocket 112 at the appropriate stack height, the latch ring 148 engages in the lock groove 118 to hold the valve cartridge 140 in place.

When the valve cartridge 140 aligns and locks in place in the housing's pocket 112, the components of the cartridge 140 align with the external opening 117 on the housing 110 so that the valve mechanism of the valve cartridge 140 can be operated. In particular, a cross passage 145 passes through the side of the cartridge 140 and passes orthogonal to the cartridge's bore 142. With the valve cartridge 140 disposed in the pocket 112, the cross passage 145 communicates with the external opening 117 on the housing 110.

The cross passage 145 holds a valve element 150 to open and close fluid communication through the cartridge's bore 142. The cross-passage 145 can be cylindrical, and the valve element 150 for its part can also be cylindrical, although the passage 145 and element 150 can have other shapes, such as spherical or conical shapes, allowing the element 150 to insert in the side of the cartridge 140 to open or close the bore 142 by its rotation. The valve element 150 defines a cross bore 152 sized for the central bore 142 of the cartridge 140. When the valve element 150 is rotated in one orientation, the two bores 142 and 152 align so fluid can pass through the internal through-bore 102 of the assembly 100. When the valve element 150 is turned 90-degrees, the element's cross bore 152 is orthogonal to the cartridge's bore 142 so that flow cannot pass through the assembly's internal through-bore 102.

The valve element 150 can have a tight tolerance to the cross passage 145 in the valve cartridge 140. For example, a tolerance of about ±0.003-in. may be used, although other tolerances may be used depending on the implementation. To maintain a seal, the valve cartridge 140 has saddle seals 143 to seal the cartridge's bore 142 at its interfaces with the valve element 150. For assembly, the valve cartridge 140 is preconfigured with the valve element 150 and saddle seals 143 disposed therein, and the valve cartridge 140 can be installed in the housing 110 as preconfigured.

Figure 7:
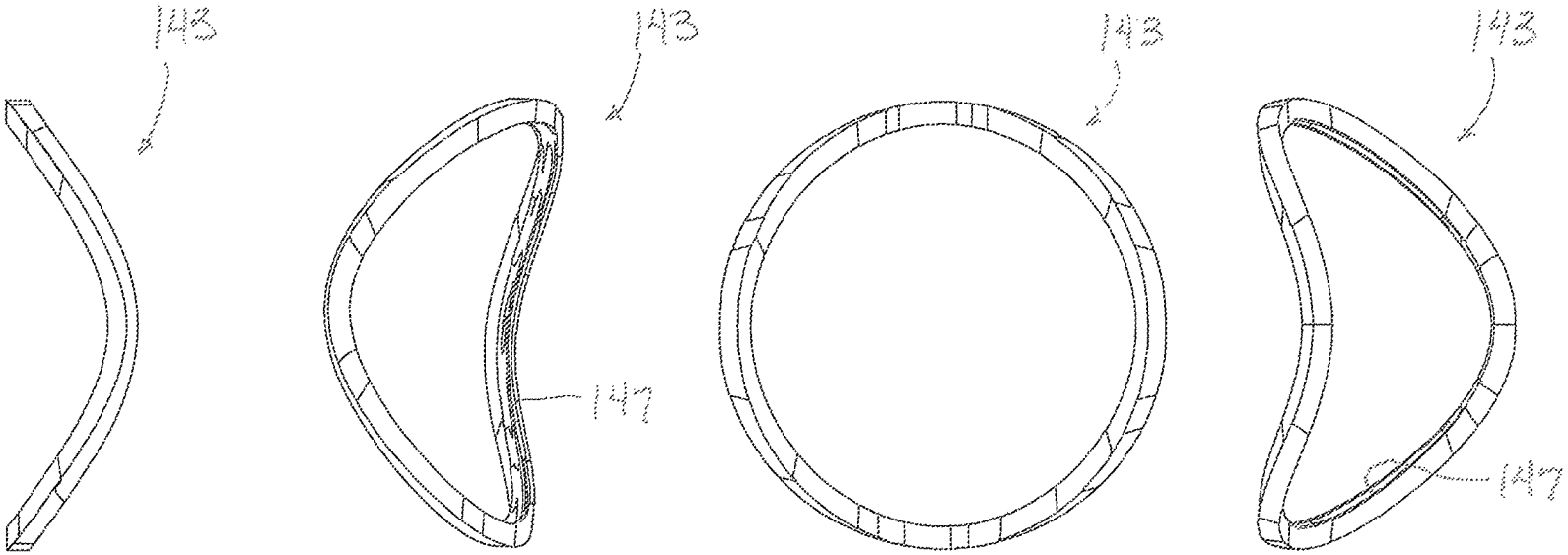
FIG. 7 illustrates a saddle seal for the disclosed valve cartridge in various views.

Briefly, FIG. 7 illustrates a saddle seal 143 for the disclosed tree assembly 100 in various views. In general, the saddle seal 143 is formed as a transverse sinusoid to conform to the cylindrical surface of the valve element (150) to which it seals. Similar to the other seals discussed above, the saddle seal 143 can be any suitable type of seal for sealing the interface between the valve element (150) and the cross passage (145) and bore (142) of the cartridge (140). For example, the saddle seal 143 can be metallic, elastomeric, or plastic and can be machined or molded. In fact, the seal 143 can be bonded to the valve element (150).

Moreover, the seal 143 can be spring energized, plastic injected, plastic energized, or wound. For example, an internal groove 147 can be defined around the inside edge of the seal 143 and can hold a spring element (not shown), such as a V-spring composed of an Elgiloy® alloy or the like. ELGILOY is a registered trademark of Elgin National Watch Company. Alternatively, the spring element (not shown) can be encapsulated in the material of the seal 143.

Returning to FIGS. 6A-6B, a spring lock 154 fits inside an internal groove in the cross passage 145 of the valve cartridge 140 and holds the valve element 150 in place. The external end of the valve element 150 has a drive head 158 to which the stem 166 of the bonnet 160 connects. This drive head 158 can be a square head or any other shape, and the bonnet's stem 166 can having an appropriately configured socket 168, such as a square socket.

Figure 8A:
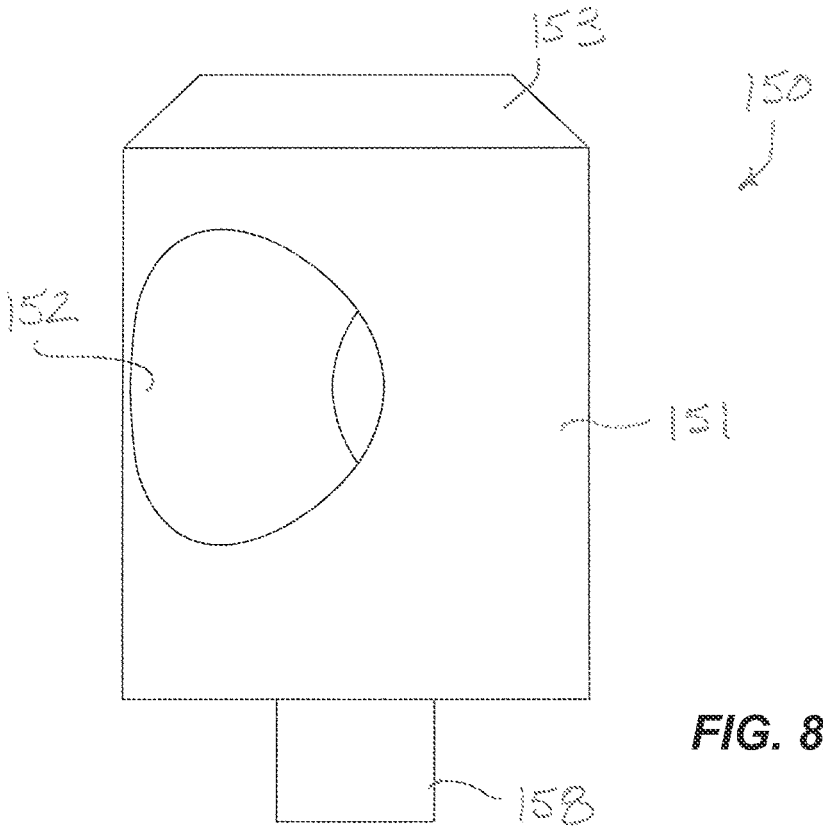
FIGS. 8A-8B illustrate a valve element for the disclosed valve cartridge in side and end views.
Figure 8B:
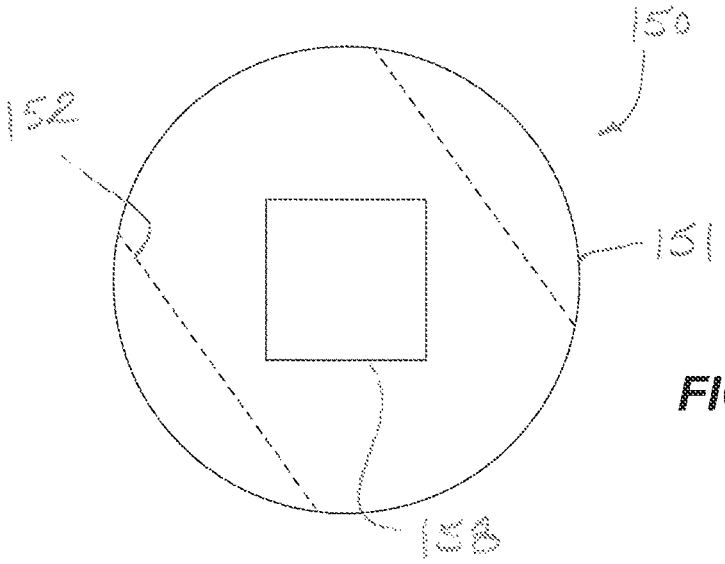

Briefly, FIGS. 8A-8B illustrate an example of a valve element 150 for the disclosed tree assembly (100) in side and end views. The valve element 150 has a body 151, which as noted previously can be cylindrical, spherical, or conical. As shown here, the body 151 is cylindrical with its outside surface intended to fit with a tight tolerance in the cross passage (145) of the valve cartridge (140). The cross-passage 152 through the body 151 passes orthogonal to the body's central axis. The distal end of the body can have a bevel 153 to help centralize the body 151 when installed in the valve cartridge (140). Other features could instead be provided, such as a stem, bearing, or the like.

As shown in the end view of FIG. 8B, the proximal end of the valve element 150 has a drive head 158 to connect to the stem (166) of the bonnet (160). In this example, the drive head 158 is square to receive a square socket (168) on the bonnet's stem (166). Other suitable configurations could be used that allow the end of the bonnet's stem (166) to connect to and rotate the valve element 150.

Returning to FIGS. 6A-6B, the bonnet 160 has a flange body 162 that affixes with stud connections to the external opening 117 and cutaway in the housing's external surface. A gasket (not labeled) is used to seal the interface. On the bonnet 160, a rotary seal mechanism 164 on the body 162 seals to the stem 166, which has a handle, lever, or other actuator 165 on its external end. Although a manual actuator 165 is shown, a hydraulic, pneumatic, or other automated mechanism can be used to turn the stem 166 to open and close the valve element 150. The other end of the stem 166 has the socket 168 that fits onto the drive head 158 of the valve element 150. The socket 168 and the drive head 158, therefore, do not require a fixed or fastened connection.

With the bonnet 160 affixed to the housing 110 and engaged with the valve element 150, the sealed space contained between the bonnet 160 and the valve cartridge 140 can be filled with light oil for lubrication. For example, a needle port 167 on the bonnet's body 162 can be used for filling the space with oil and for testing for pressure leaks. When the bonnet 160 is installed on the housing 110 during assembly, the light oil is held sealed inside the space.

Because the valve element 150 only needs to rotate 90 degrees to fully open and close the valve, less drag or friction is expected from the rotating valve element 150 than found in a conventional gate valve that requires a gate to slide past high-strength seal rings inside the gate valve. Together, the light oil and the tight tolerance between the valve element 150 and the cartridge's cross passage 145 form a laminar bearing between the valve element 150 within the cross passage 145. Thus, during operation, this laminar bearing can facilitate turning of the valve element 150 within the cross passage 145.

In this and other embodiments of the valve cartridge 140, the valve element 150 is a rotatable element disposed in the cross passage 145 to open and close fluid communication through the cartridge's bore 142. Although this may be preferred in some implementations, other valve mechanisms can be used inside the cartridge 140. For example, the cartridge 140 can use a slab gate valve, a split gate valve, a globe valve, a ball valve, a choke valve, or other type of mechanism to open and close fluid communication through the cartridge's bore 142.

Figure 9:
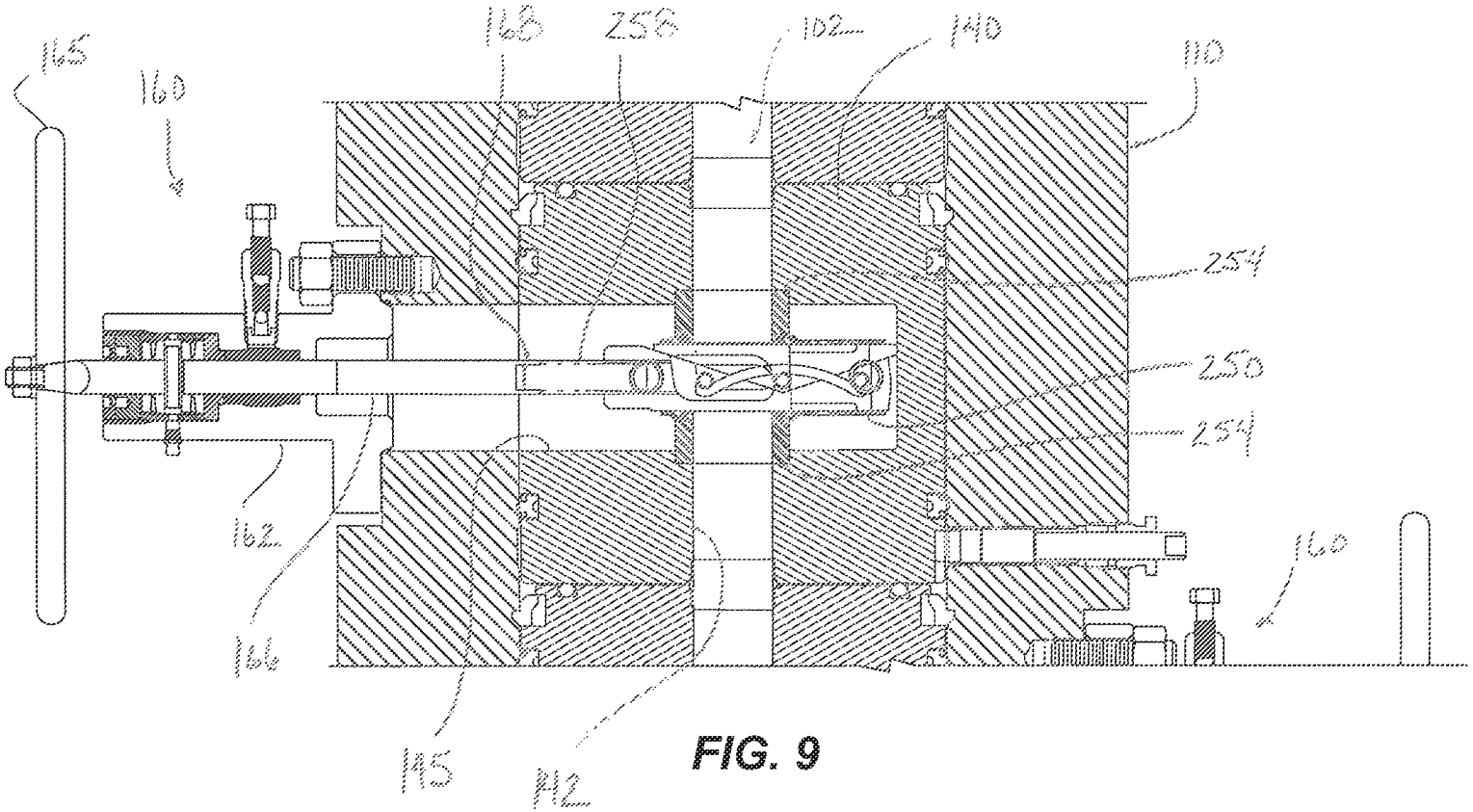
FIG. 9 illustrates a side-sectional view of a valve cartridge and a bonnet that use a gate valve mechanism.

As shown in FIG. 9, for example, another embodiment of a valve cartridge 140 has a slab valve or split gate valve mechanism 250 disposed in the cross passage 145 of the cartridge 140. The cross passage 145 does not need to be cylindrical and instead may be rectangular to accommodate the mechanism 250. The gate mechanism 250 can have a single gate with an opening or can have a parallel expanding gate with an opening. Moved by activation from the bonnet 160, the opening in the mechanism 250 can move into and out of alignment with the cartridge's bore 142 to control flow through the gate mechanism 250. Retaining rings 254 dispose on either side of the gate mechanism 250 and seal the gate mechanism 250 with the cartridge's bore 142.

As before, the bonnet 160 can have a stem 166 with a socket 168 that connects to a rotating rod 258 of the gate mechanism 250. Rotation of the stem 168 with the handle 165 or automated actuator turns the corresponding rod 258 of the gate mechanism 250. In turn, the gate mechanism 250 slides in and out of alignment with cartridge's bore 142 to open or close fluid flow therethrough. Other details of the cartridge valve 140 and bonnet 160 can be similar to those discussed previously.

C. Exemplary Dimensions and Ratings

As noted above, the tree assembly 100 can be versatile and modular, allowing operators to configure and assemble the tree assembly 100 that fits the needs of a desired implementation. Exemplary dimensions and pressure ratings are given in FIGS. 4B and 5B for the assemblies 100. As shown, the assembly 100 can have a 13⅝-in. connection 114*a-b* rated for 10-kpsi. The inner bore 102 of the assembly 100 can have a diameter of about 4.075-in., and the pocket 112 of the housing 110 can have a diameter of about 8.953-in.

Figure 1:
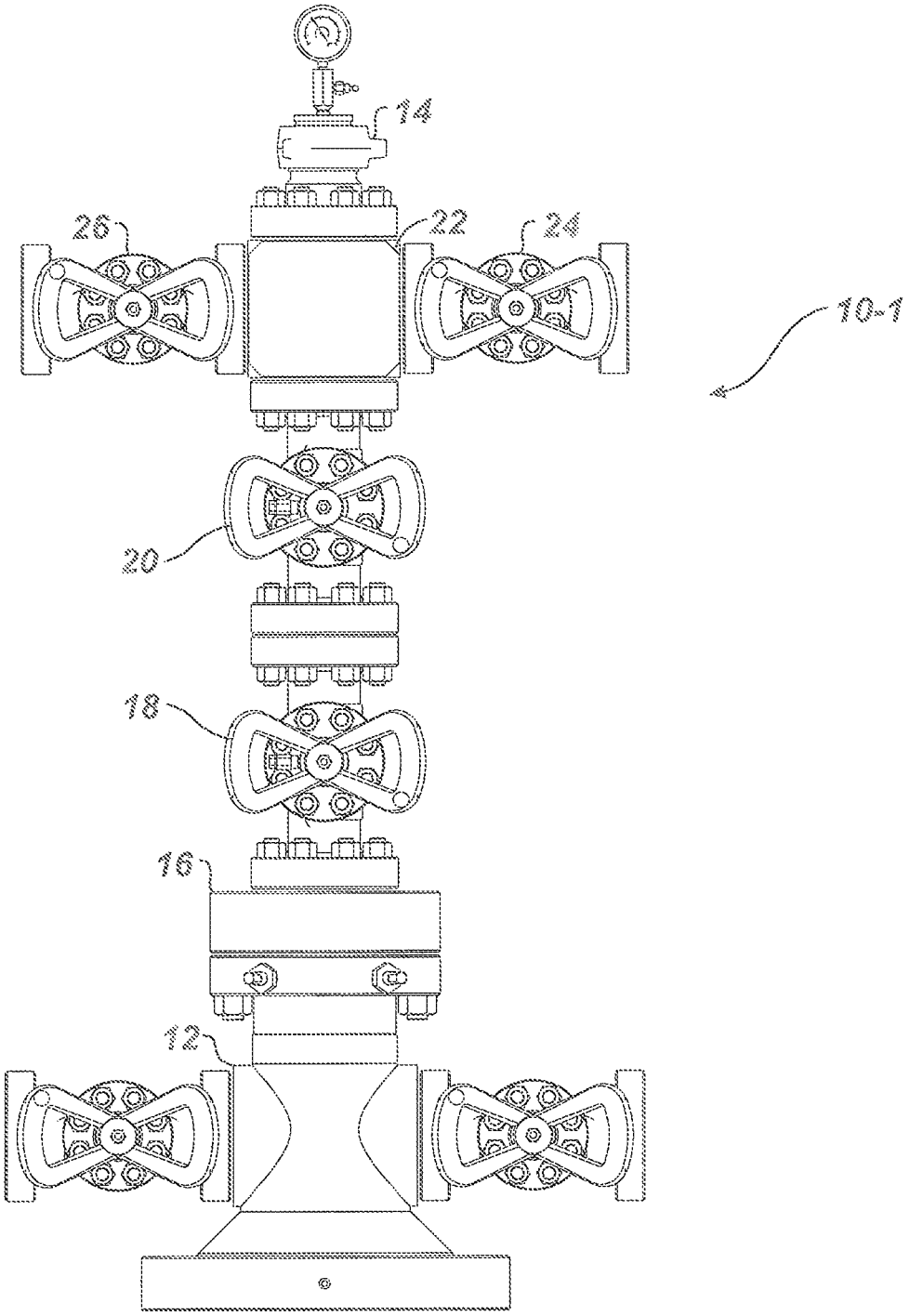
FIG. 1 (Prior Art)
FIG. 1 illustrates an elevational view of a Christmas tree having master valves according to the prior art.
Figure 2:
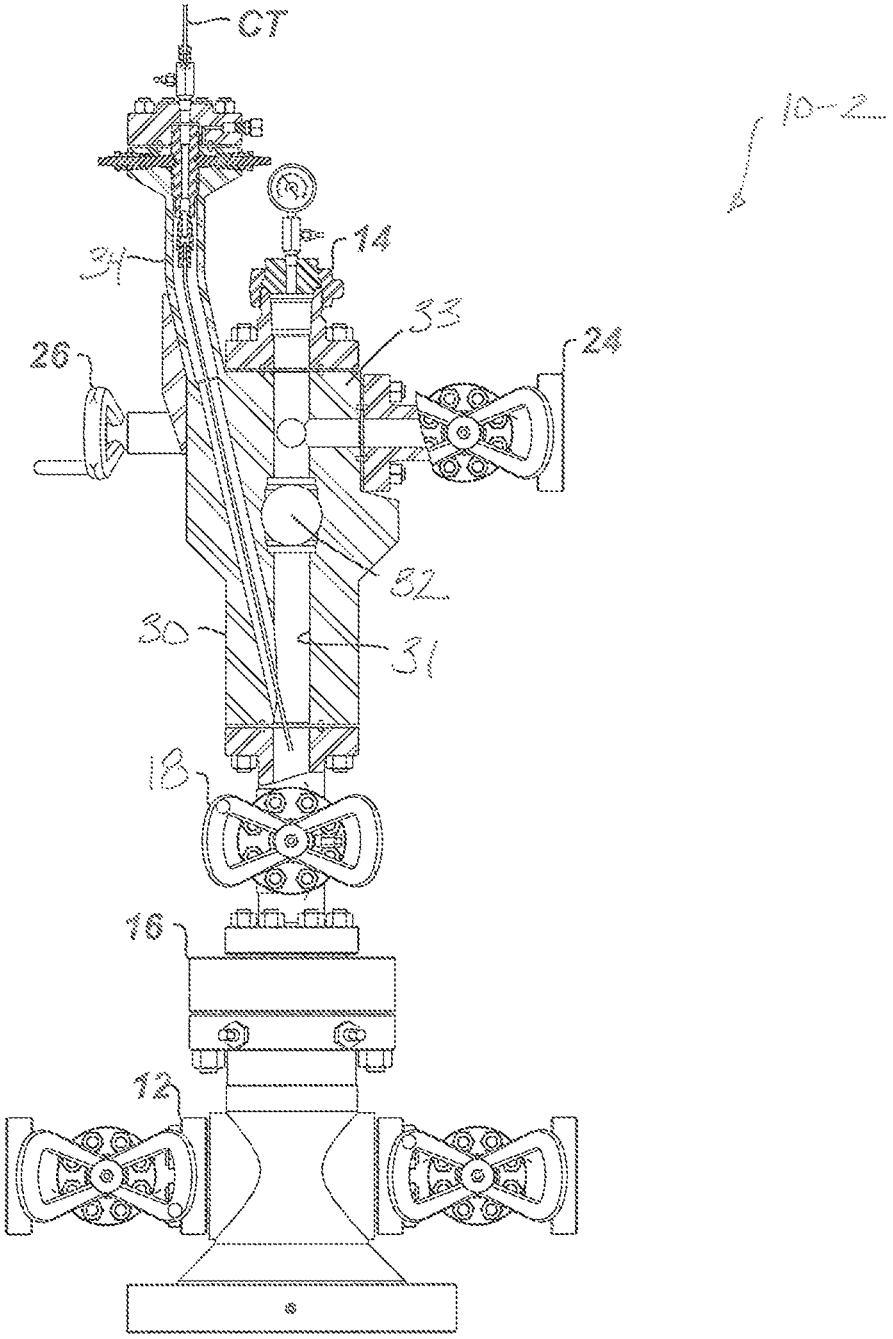
FIG. 2 (Prior Art)
FIG. 2 illustrates a partial cross-sectional view of a Y-body Christmas tree according to the prior art.
Figure 3A:
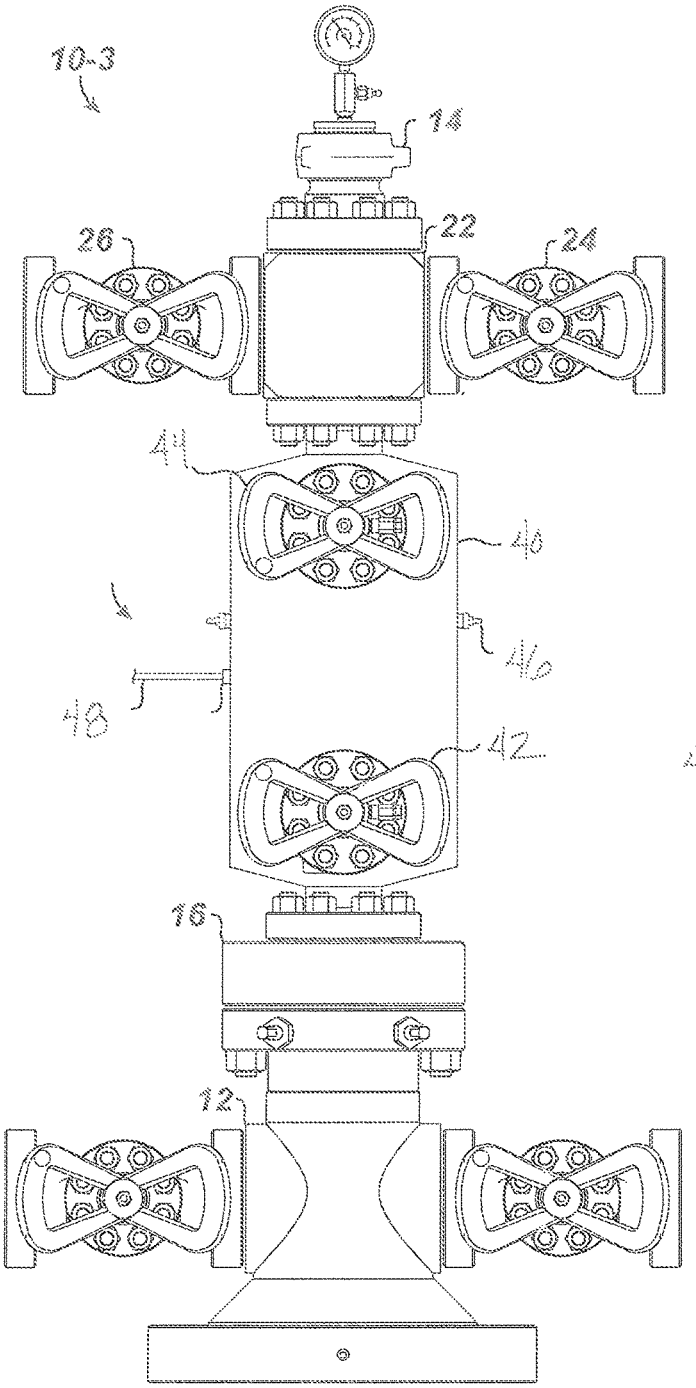
FIG. 3A (Prior Art)
FIG. 3A illustrates an elevational view of a Christmas tree having an integral body with master valves according to the prior art.
Figure 3B:
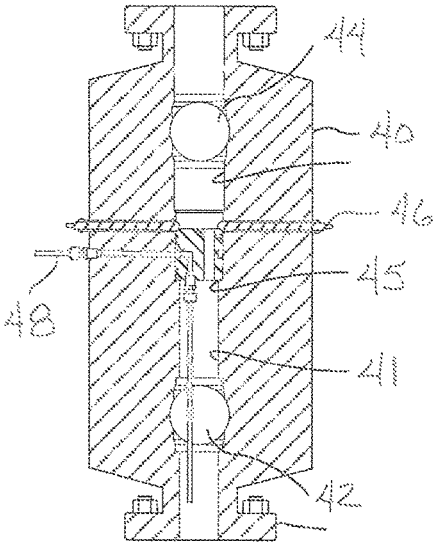
FIG. 3B (Prior Art)
FIG. 3B illustrates a cross-sectional view of the integral body of FIG. 3A.
Figures 1, 10A:
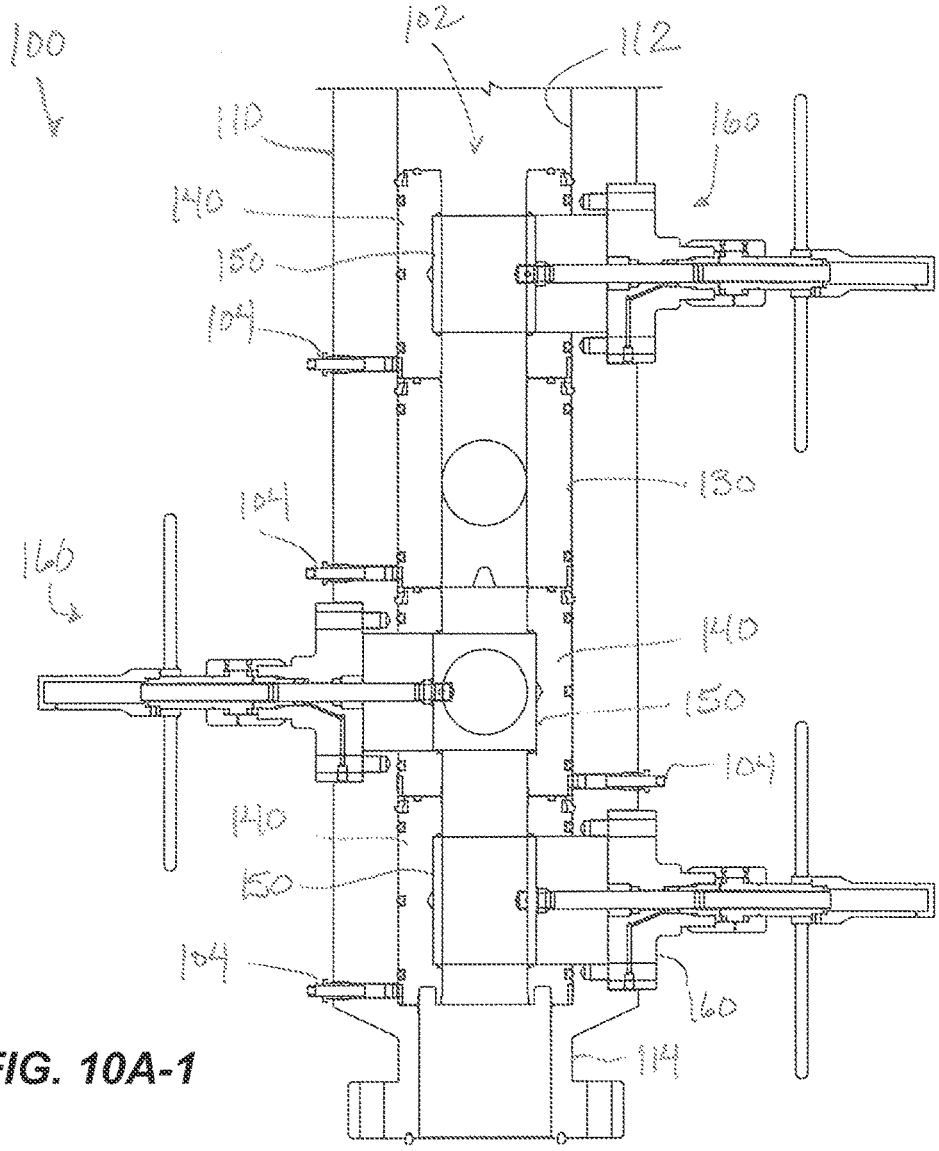
Figures 2, 10A:
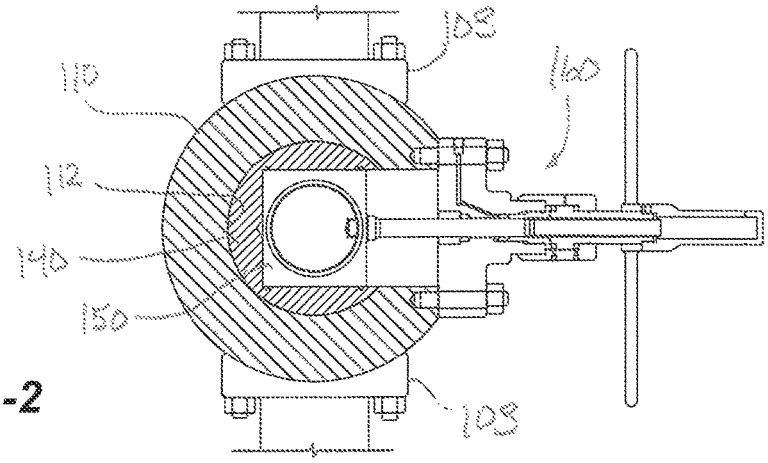
Figures 1, 10B:
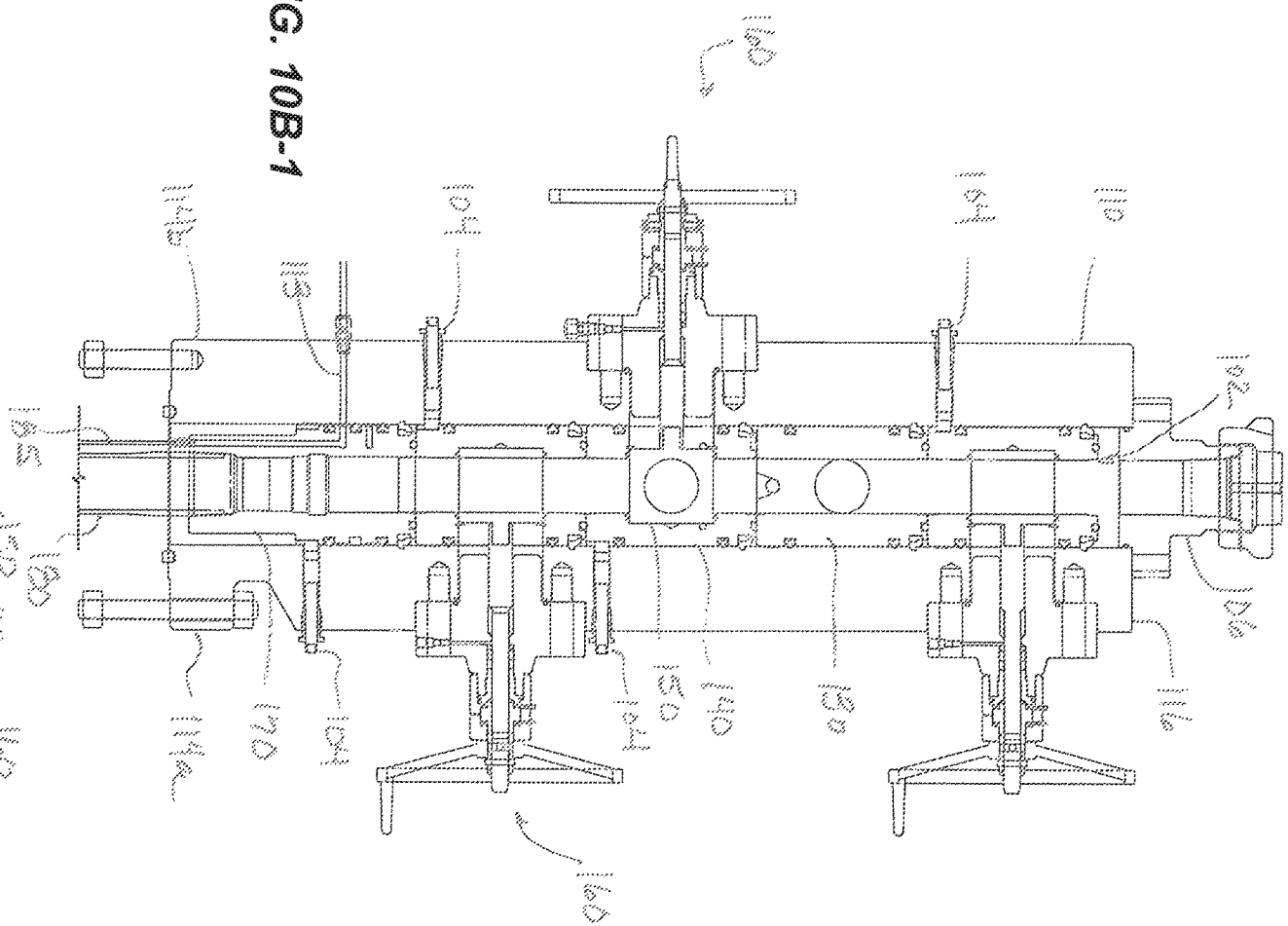
Figures 2, 10B:
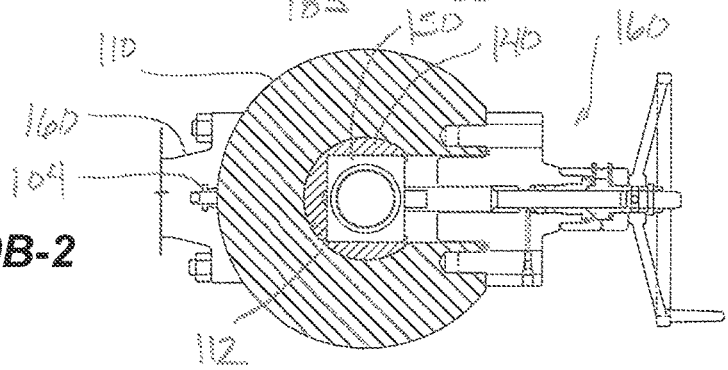

FIGS. 10A-1 and 10A-2 illustrate side and end sectional views of a tree assembly having an 11-in. flanged connection 114*a* rated for 5-kpsi. Internally, the central through-bore 102 of the assembly 100 is configured for 7 1/16-in. In another example, FIGS. 10B-1 and 10B-2 illustrate side and end sectional views of another tree assembly having a 7-in. flanged connection 114*a* rated for 5-kpsi. Internally, the central through-bore 102 of the assembly 100 is configured for less than 7-in.

The above dimensions and ratings are meant only to be illustrative. Based on previous discussions, it will be appreciated that any other suitable dimensions and ratings may be used.

D. Further Details of Various Cartridges

As noted above, various types of cartridges can be used in the assembly. Further details of some of the various cartridges are shown in FIGS. 11A-11D, 12A-12D, and 13A-13D. As discussed and shown elsewhere, the various cartridges, such as the valve cartridge (140), the spacer cartridge (120), the cross cartridge (130), and the hanger cartridge (170) as disclosed herein have similar features to align, lock, and seal inside the pocket 112 of the housing 110. Accordingly, each of the various cartridges (120, 130, 140, 170 . . . ) can have alignment slots, external seals, upper seals, and latch ring similar to one another.

1. Valve Cartridge

FIGS. 11A-11D show side, front, top, and back views of a valve cartridge 140, such as discussed above. As noted previously, the valve cartridge 140 has an alignment slot 144, external seals 146, upper seal or gasket 147, and latch ring 148.

The latch ring 148 can be comprised of several independent or interconnected segments or dogs 149 as shown. More or less of these segments 149 may be used, and the latch ring 148 need not necessarily extend around the entire perimeter of the cartridge's upper edge as shown. Instead, a few (e.g., two, three, or four) segments 149 of the latch ring 148 may be positioned around the cartridge's upper edge.

In any event as noted above, the lock in the form of the latch ring 148, segments 149, or the like in general uses an upward-facing shoulder that is biased to an extended position to engage a downward-facing shoulder of an internal groove (118) in the housing's pocket 112. Moreover, as noted above, other mechanisms such as external lock screws (not shown) can be used to hold the cartridge 140 in the housing (110) so that the external surface of the cartridge 140 may have conventional features for lock screws rather than the latch ring 148 shown. The external lock screws can engage side pockets, shoulders, or ledges (not shown) in the cartridge's outer surface or upper edge to hold it in place.

As described elsewhere, the valve element 150 disposes in the cross passage 145, and the spring lock 154 holds the valve element 150 in place. The drive head 158 on the valve element 150 does not extend outside the outer profile of the valve cartridge 140 so as not to interfere with its insertion and removal of the valve cartridge 140 from the housing (110).

2. Spacer Cartridge

Figure 12A:
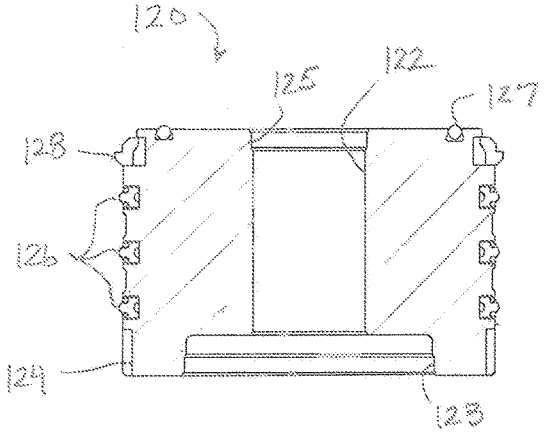
FIGS. 12A-12D illustrates cross-sectional views of spacer cartridges for the disclosed tree assembly.
Figure 13B:
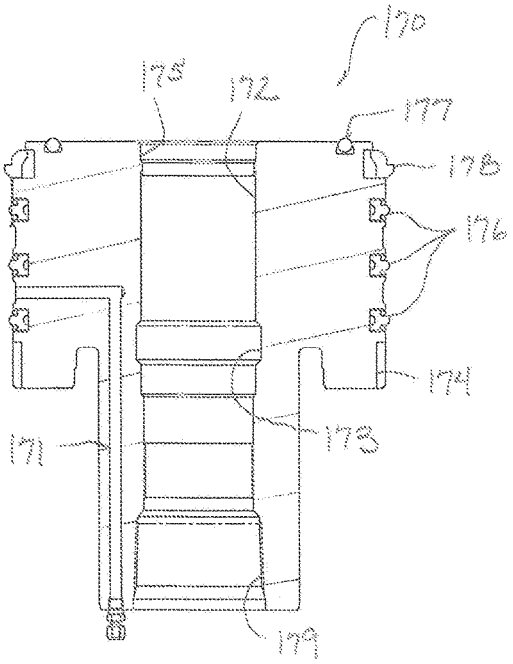
FIGS. 13A-13D illustrate cross-sectional views of various embodiments of hanger cartridges for the disclosed tree assembly.
Figure 13A:
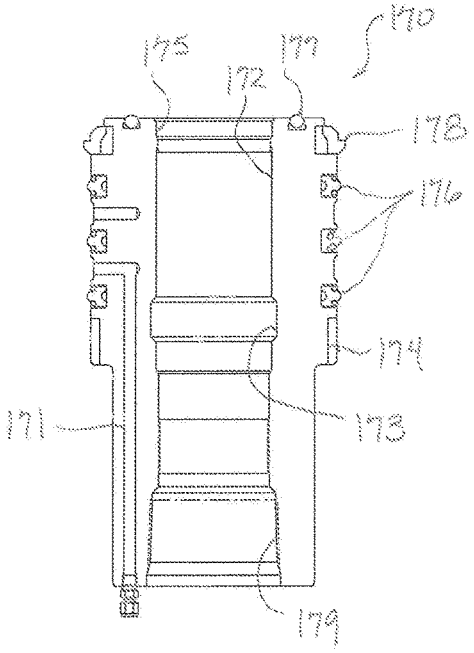
Figure 13C:
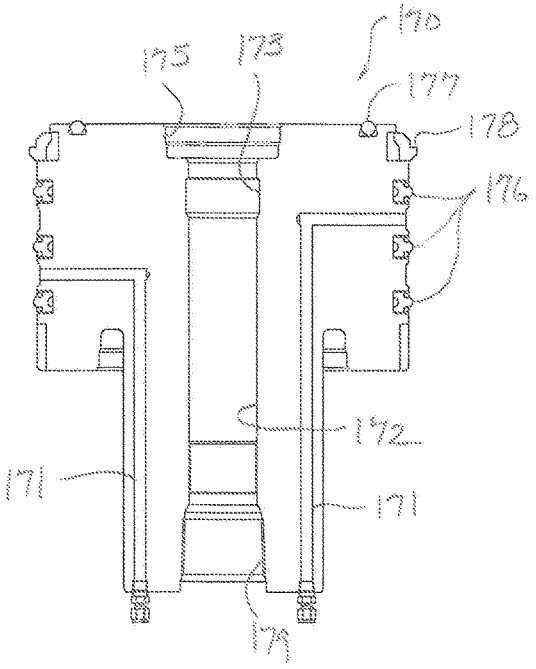

FIG. 12A shows a spacer cartridge 120. As with the other cartridges, the spacer cartridge 120 has alignment slots 124, external seals 126, upper seal or gasket 127, and latch ring 128 similar to those shown for the valve cartridge 140. This spacer cartridge 120 may be intended for use as the lower most cartridge in the assembly (100) so that the cartridge's bore 122 can have a widened lower end 123 to mate up with the lower bore (115: FIGS. 4A-4C) of the housing (110). An upper lip 125 on the cartridge's bore 122 can accommodate one of the bore seals (105: FIGS. 4A-4C) used between stacked cartridges. Because the spacer cartridge 120 may be used in positions in the housing (110) having side ports (113) for control lines and the like, several external seals 126 may be used to isolate these ports (113) from one another.

Figure 12B:
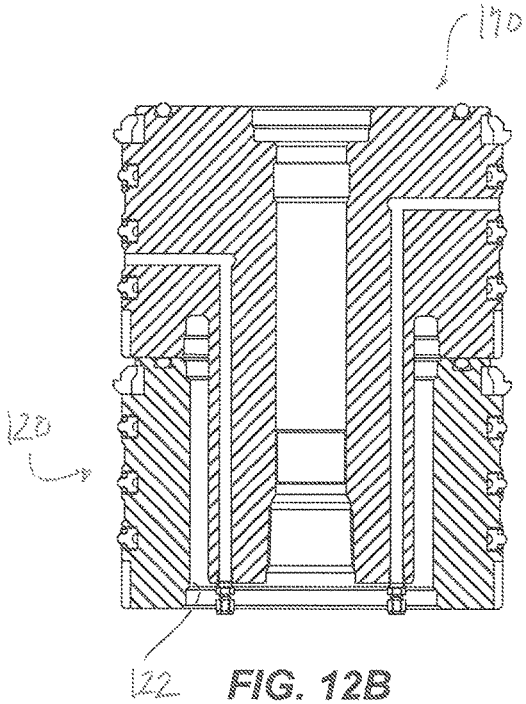
Figure 12C:
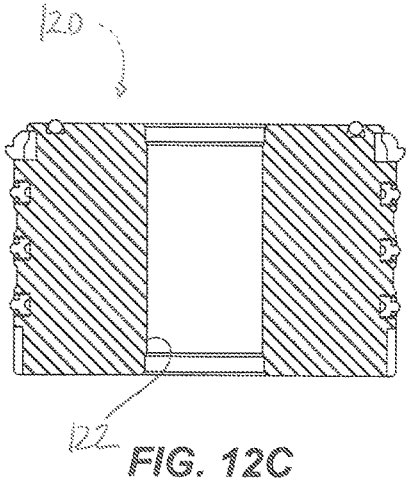
Figure 13D:
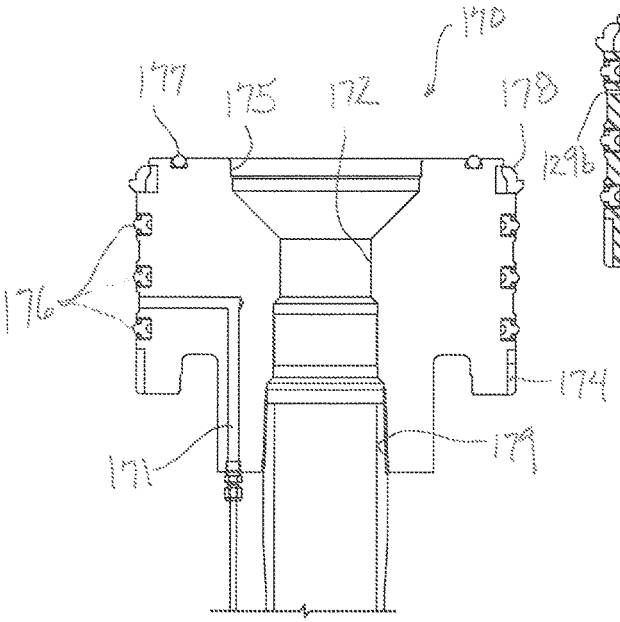

Because the spacer cartridge 120 may be used as the lowermost cartridge in the housing's internal pocket (112), the entire extent of its bore 122 as shown on the cartridge 120 of FIG. 12B may have a dimension comparable to the lower bore (115: FIGS. 4A-4C) of the housing (110). In this instance, it is possible for a hanger cartridge 170, such as discussed below, to be stacked atop the spacer cartridge 120 with the extending end of the hanger cartridge 170 capable of supporting a tubular (not shown) through the wider bore 122 of the spacer cartridge 120.

Moreover, although the spacer cartridge 120 may be used as the lowermost cartridge, this is not strictly necessary. For example, the spacer cartridge 120 can instead be used in any other location along the stack of cartridges in the housing's internal pocket (112) to space out the arrangement as needed. In such a case, the bore 122 as shown on the cartridge 120 of FIG. 12C may not have such a widened lower end and would instead be comparable to other cartridges.

Figure 12D:
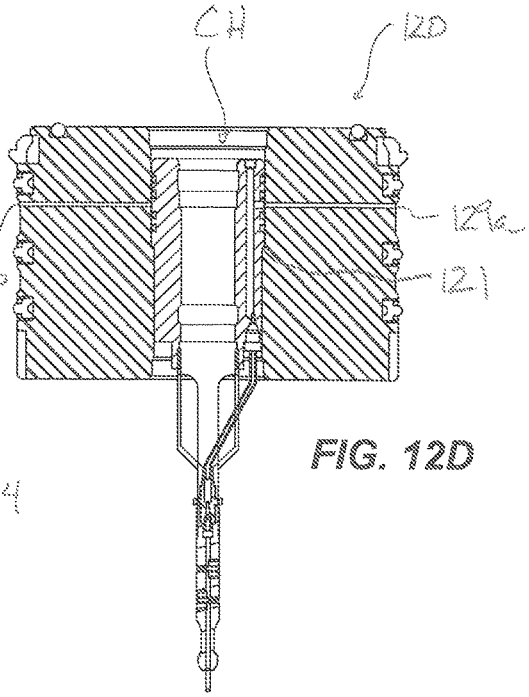

Finally, a spacer cartridge 120 may also operate as a hanger or other component. As shown in FIG. 12D, for example, the bore 122 of the cartridge 120 can define a profile, nipple, or shoulder 121 on which an inserted component can land. For instance, a capillary hanger CH to hold a capillary string can install in the cartridge's bore 122 and can land on the shoulder 121. One side port 129*a* in the cartridge 120 can communicate with the capillary hanger CH to fluid can be communicated from an external control line on the housing (110). Another side port 129*b* can receive a setting pin (not shown) to hold the capillary hanger CH in the bore 122.

3. Hanger Cartridge

In FIGS. 13A-13D, various embodiments of hanger cartridges 170 for the disclosed tree assembly (100) are illustrated. As with other cartridges, each of the hanger cartridges 170 has alignment slots 174, external seals 176, upper seal or gasket 177, and latch ring 178. The hanger cartridge 170 can be used as the lowermost cartridge in the assembly (100) to support tubing, such as a velocity string (180: FIGS. 5A-5C), so that the cartridge's bore 172 can have an internal threaded connection 179 to connect with such tubing. An upper lip 175 on the cartridge's bore 172 can accommodate one of the bore seals (105: FIGS. 5A-5C) used between stacked cartridges. The inside of the through-bore 172 may also have any type of appropriate profile 173 for engaging and holding any suitable type of tool, such as a hanger, a backpressure valve, a check valve, a running tool, a profile gauge, and a master bushing, as just a few examples.

Additionally, the hanger cartridge 170 can be used in positions in the housing (110) having side ports (113) for control lines and the like so that several external seals 126 can be used to isolate these ports (113) from one another. Using these ports (113), the hanger cartridge 170 can be used for electrical feed, hydraulic pressure, fluid injection, or the like. In particular, one or more internal flow passages 171 defined in the cartridge 170 place capillaries (185: FIGS. 5A-5C) or other lines in communication with the side ports (113) for injecting fluids into the well, for controlling downhole safety valves or other devices, or for any other purposes.

The various cartridges in FIGS. 12A-12D and 13A-13D show some additional aspects related to the cartridges disclosed herein. For example, the spacer cartridge 120 in FIG. 12A may define an external dimension of 11-in. and an internal bore dimension of 7-in. The hanger cartridge 170 in FIG. 13A may define an external dimension of 11-in. and an internal bore dimension of 5-in. The hanger cartridge 170 in FIG. 13B may define an external dimension of 13-in. and an internal bore dimension of 4-in. The hanger cartridge 170 in FIG. 13C may define an external dimension of 13-in. and an internal bore dimension of 2⅜-in. Additionally, the hanger cartridges 170 in FIG. 13A-13D, as well as any of the other cartridges disclosed herein, can have a wireline preparation (e.g., internal fishing neck profile), a Type H BPV thread, EUE tubing hanger thread, or other comparable features.

E. Assembly Steps

In general, the tree assembly 100 can be pre-assembled as a unit and then installed on the wellhead. Alternatively, the tree assembly 100 can be assembled piecemeal wise on the wellhead. In any event, modification of the tree assembly 100 after installation would involve a number of steps of stacking and unstacking cartridges in the housing 10.

FIGS. 14A-14G illustrate the disclosed tree assembly 100 in stages of assembly, either on a wellhead (not shown) or separately. To install the assembly 100 on a wellhead, the wellbore is closed using conventional methods, such as installing a back pressure valve 204 in the wellhead. As is known, the back pressure valve 204 operates as a one-way check valve sealing off downhole tubing pressure while modifications can be made at the surface, such as removing a blowout preventer form the wellhead and installing the tree assembly 100 in its place.

The housing 110 installs on a tubing adapter or head (not shown) of the wellhead and affixes with a flanged or studded connection 114*a*-*b* as discussed above. According to the desired arrangement, operators then stack the desired cartridges (120, 130, 140, 170 . . . ) in the internal pocket 112 in the housing 110 using wireline, slickline, or related forms of operation.

Figure 14A:
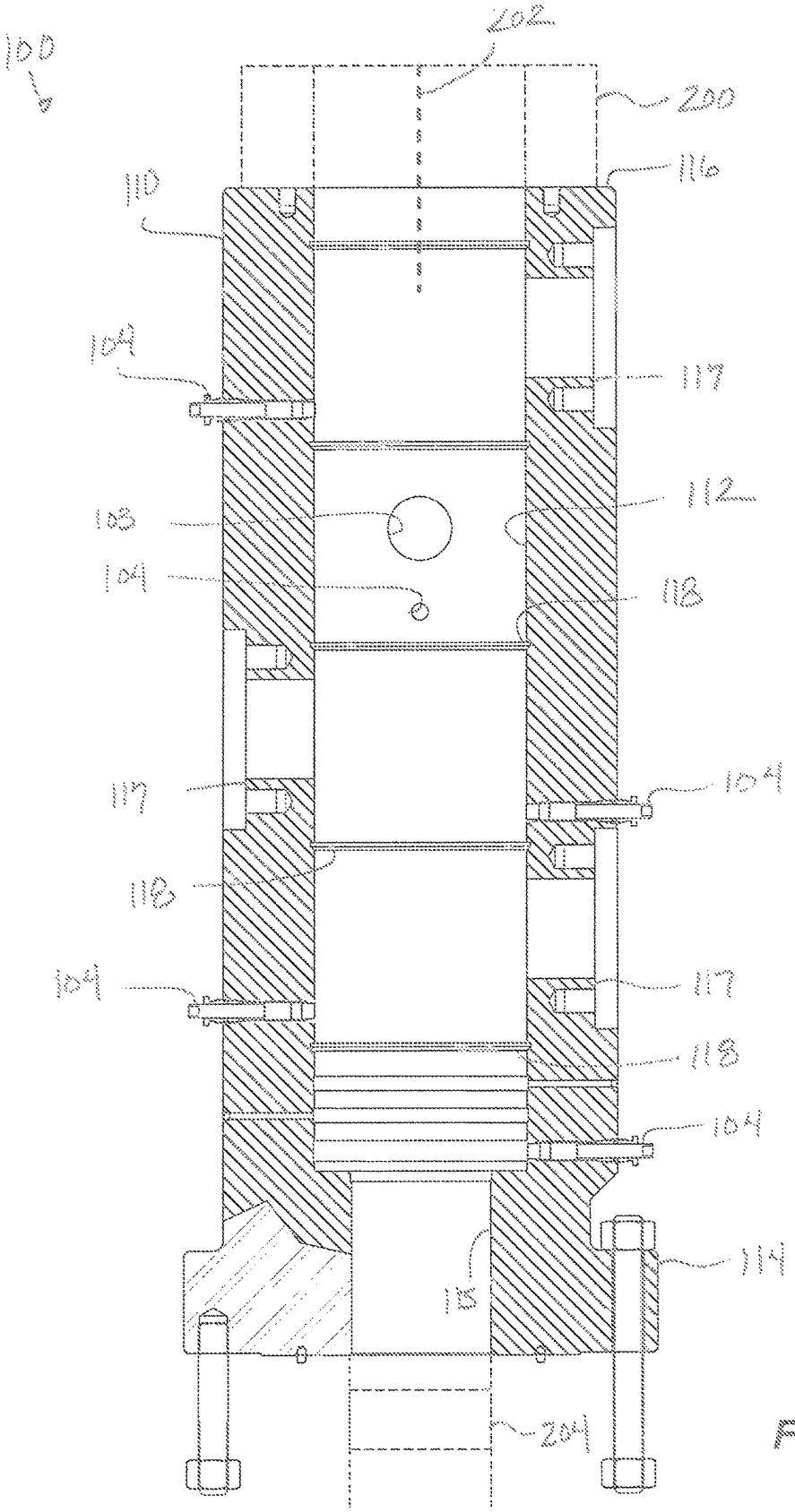
FIGS. 14A-14G illustrate the disclosed tree assembly during stages of assembly.
Figure 14B:
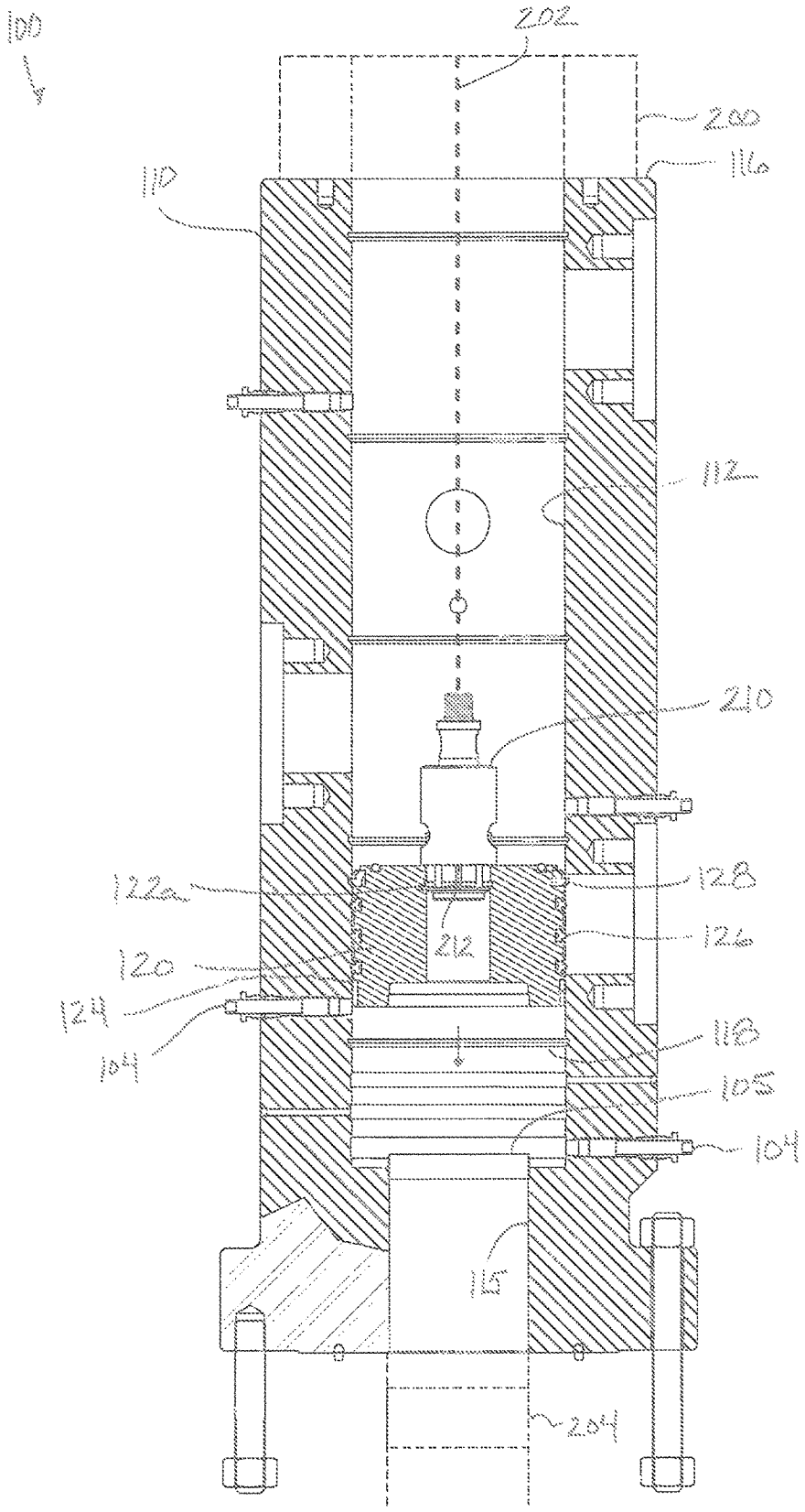
Figure 14C:
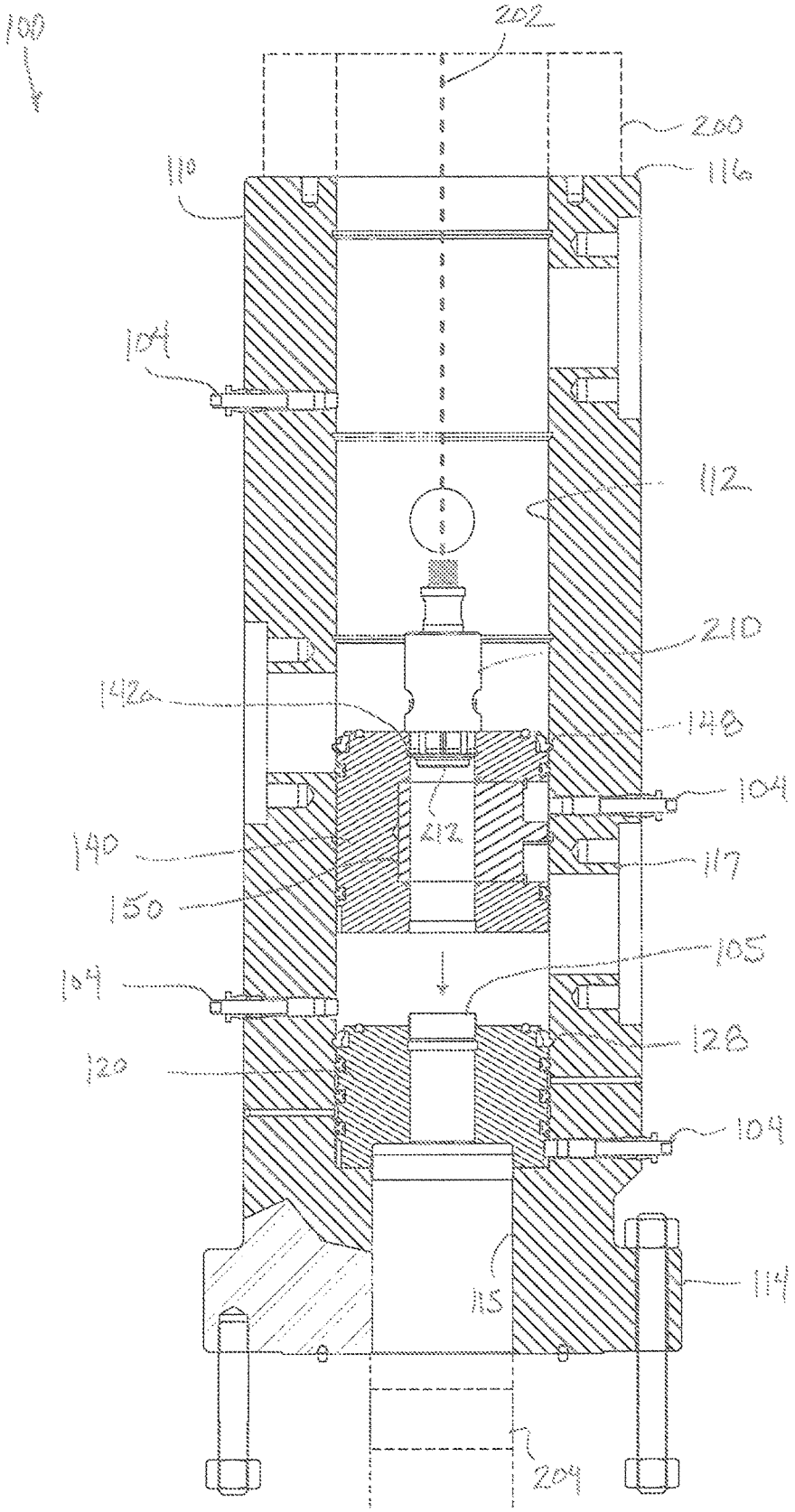

For example, FIG. 14B shows a spacer cartridge 120 being installed in the pocket 112 using wireline or slickline 202 from a wireline assembly 200 installed on the top connection 116 of the housing 110. The assembly 200 and wireline 202 are used to lower the cartridge 120 down to the lower end of the pocket 112.

The wireline 202 has a running tool 210 on its end that releasably couples to the cartridge 120, allowing the tool 210 to lower and then release the cartridge 120 in position. Any suitable type of running tool 210 can be used. In the present example, the running tool 210 can be a GS-type pulling tool having biased keys 212 disposed on a core. The biased keys 212 engage in an internal fishing neck 122*a* defined in the bore 122 of the cartridge 120 as the cartridge 120 is lowered. Once the cartridge 120 is set in place, the latch ring 128 engages inside the lock profile 118 in the housing 110.

The tool 210 can then be released from the cartridge 120 by jarring down or can be released by jarring upward if an additional adapter is used. The jarring breaks a shear pin and releases the keys 212 of the tool 210 from the profile 122*a*. The released keys 212 retract and allow the tool 210 to be removed from the cartridge 120.

Rather than a running tool 210, any of a number of procedures can be used to raise and lower the cartridges in the housing 110. For example, coupling ports (not shown) may be defined in the top surface of the cartridge for releasably coupling to coupling pins (not shown) used to connect and disconnect wireline to the cartridge. These and any other suitable procedure can be used to raise and lower the various cartridges in the housing 110.

As noted previously, the latch ring 128 is disposed externally around the upper edge of the cartridge 120. As the cartridge 120 is lowered into the internal pocket 112, lower cam surface on the latch ring 128 pushes the ring 128 inward on the cartridge 120 and allows the ring 128 to pass the locking grooves 118 and other features inside the pocket 112. When the cartridge 120 reaches its resting location, the ring 128 extends outward so that the upward facing shoulder will engage the downward facing shoulder of the locking groove 118 and hold the cartridge 120 in place.

The alignment pin 104 for the spacer cartridge 120 is extended into the internal pocket 112 to fit into the alignment slot 124 in the lower edge of the spacer cartridge 120. All of the other pins 104 along the housing 110 are retracted so as not to interrupt passage of the cartridge 120 through the internal pocket 112.

Figure 14D:
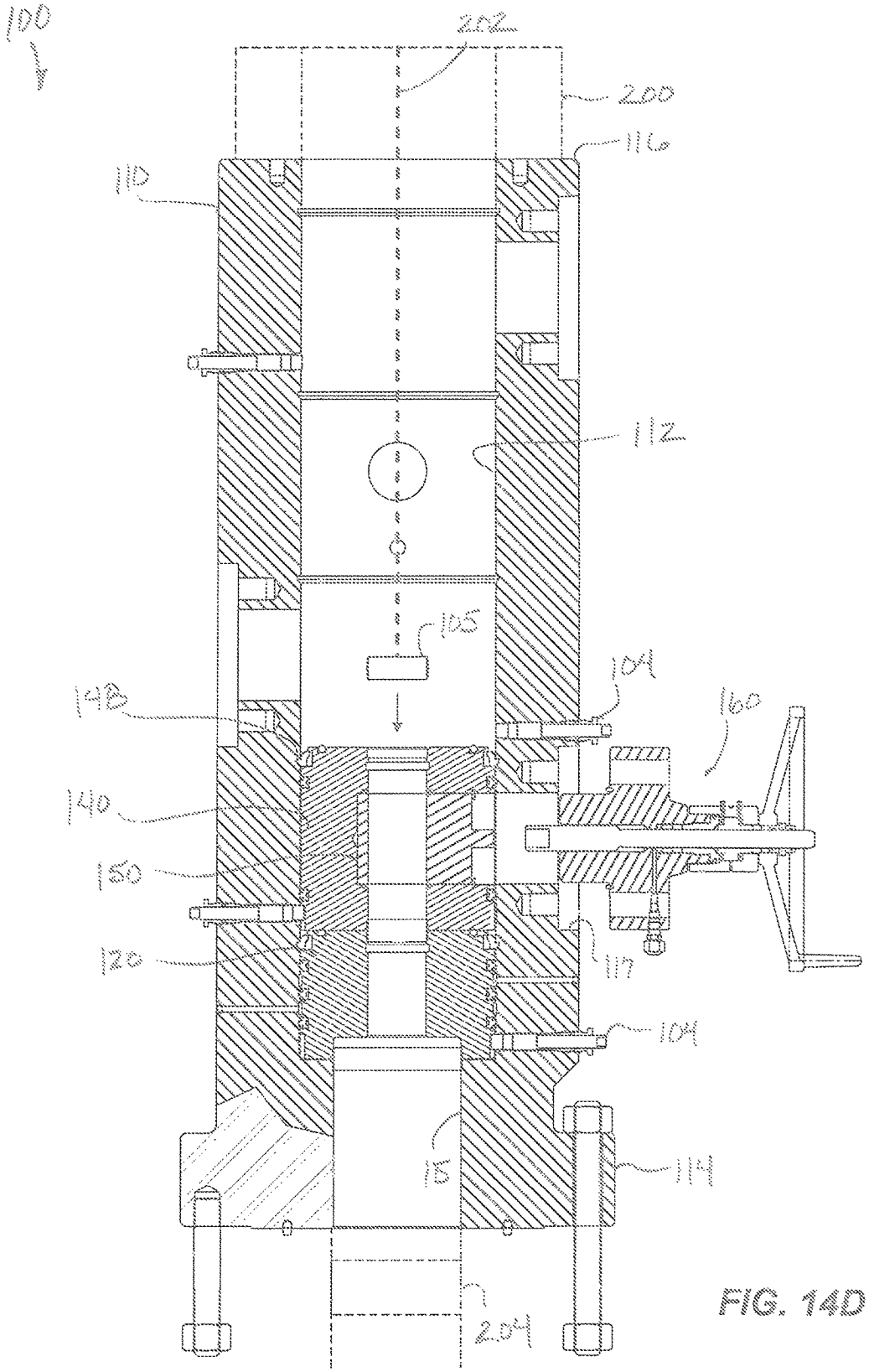

As shown in FIGS. 14C-14F, the other cartridges (130, 140, . . . ) are installed in a similar fashion as one another. Before lowering a new cartridge, the bore seals 105 can be affixed in the top lips of the last installed cartridge to engage the lower end of the bore in the next stacked cartridge. As shown in FIG. 14D, these bore seals 105 can be installed using wireline 202 or other suitable procedure, such as manually through the bonnet opening 117.

Because the cartridges (120, 130, 140, 170, . . . ) can have an outer cylindrical shape, the cartridges (120, 130, 140, 170, . . . ) may need to be specifically oriented when run into the internal pocket 112 so that any cross passages or ports will align appropriately with side openings 103, 113, 117, etc. in the housing 110 for bonnets 160, flow connections, etc. To help align the cartridges (120, 130, 140, 170, . . . ) in the housing 110, the alignment pins 104 noted above sealably fit through side holes in the housing 110 and tighten to engage in alignment slots on the outside of the cartridges.

Figure 14E:
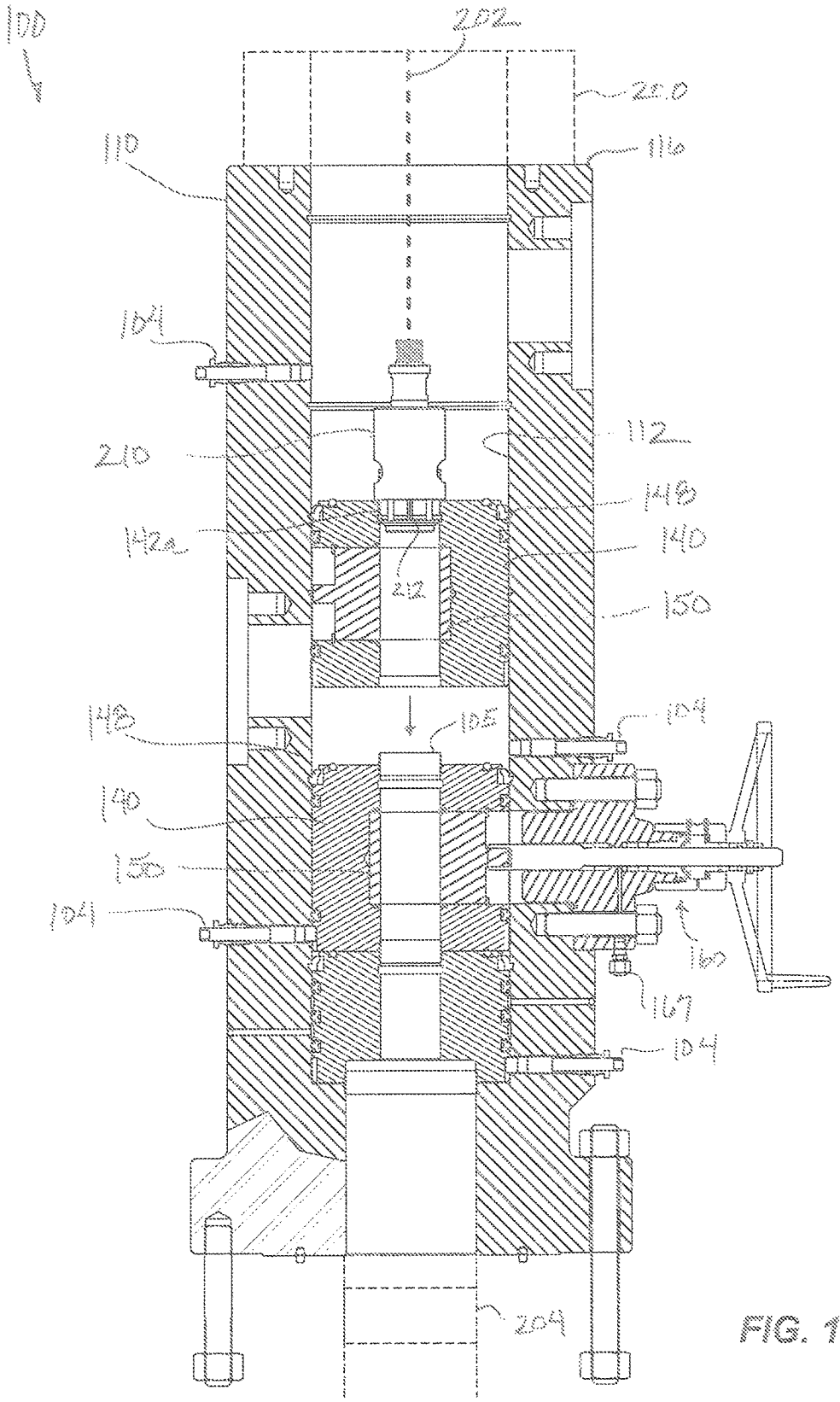
Figure 14F:
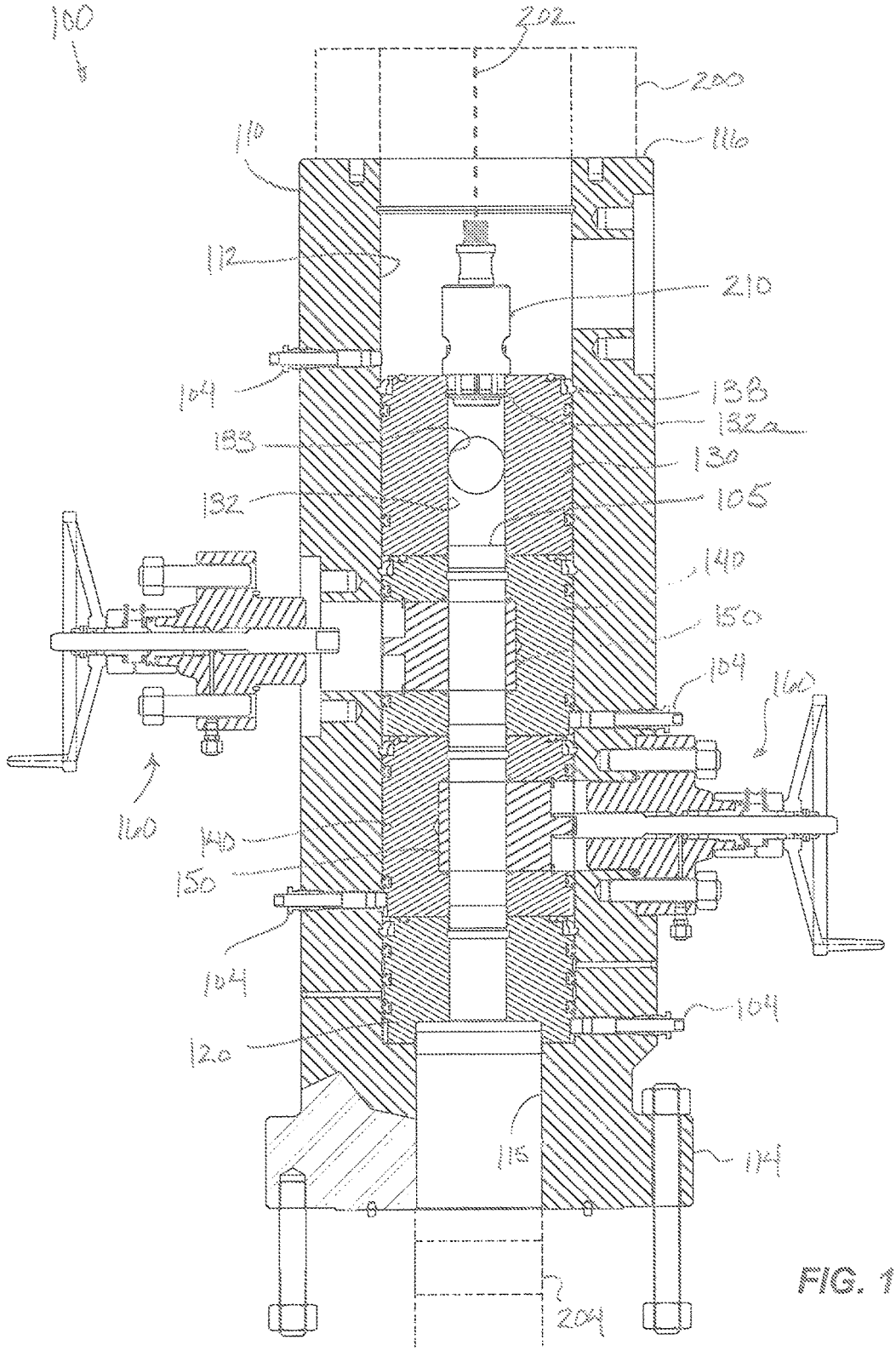

For the valve cartridge 140, such as shown in FIGS. 14D-14E, the bonnet 160 installs in the side opening 117 of the housing 110 once the valve cartridge 140 is in position. The stem's socket 168 engages the drive head 158 on the cartridge's valve element 150. The internal space is filled with light oil by filling through the needle port 167 while air is bled off.

Figure 14G:
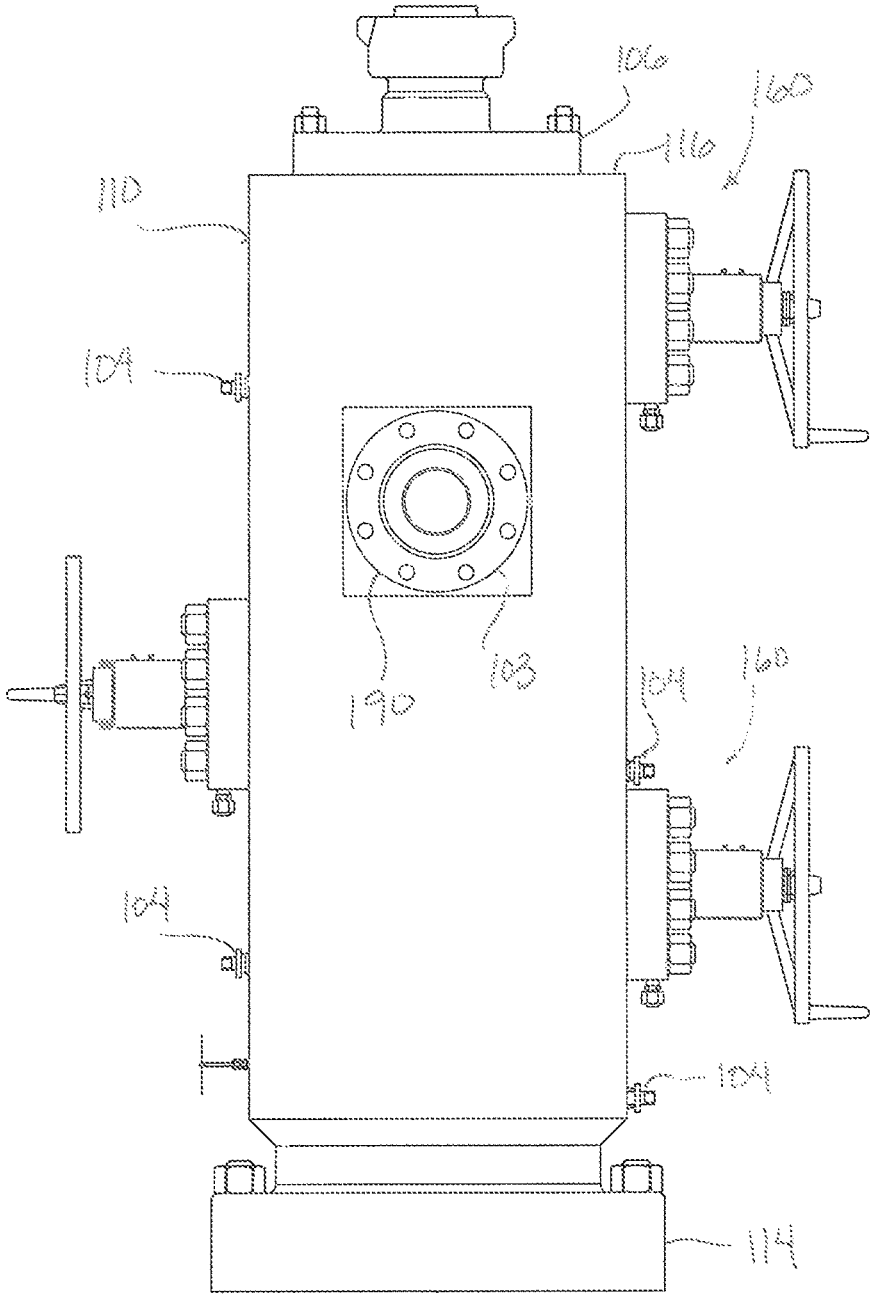

Finally, as shown in FIG. 14G, the top connector 106 can be installed on the top end 116 of the housing 110 and any additional piping can be attached to the tree assembly 100 once all of the cartridges (120, 130, 140, 170, . . . ) have been installed. For the cross cartridge 130, for example, external flow components (e.g., 190: FIG. 14G) connect to the external opening 103 on the side of the housing 110 using studded connections. Preferably, the surfaces of the housing 110 around the openings 103 and 117 are flat, and gaskets are used for sealing. At this point, the assembly 100 can be used for production operations.

F. Steps to Modify the Tree Assembly

Figure 15:
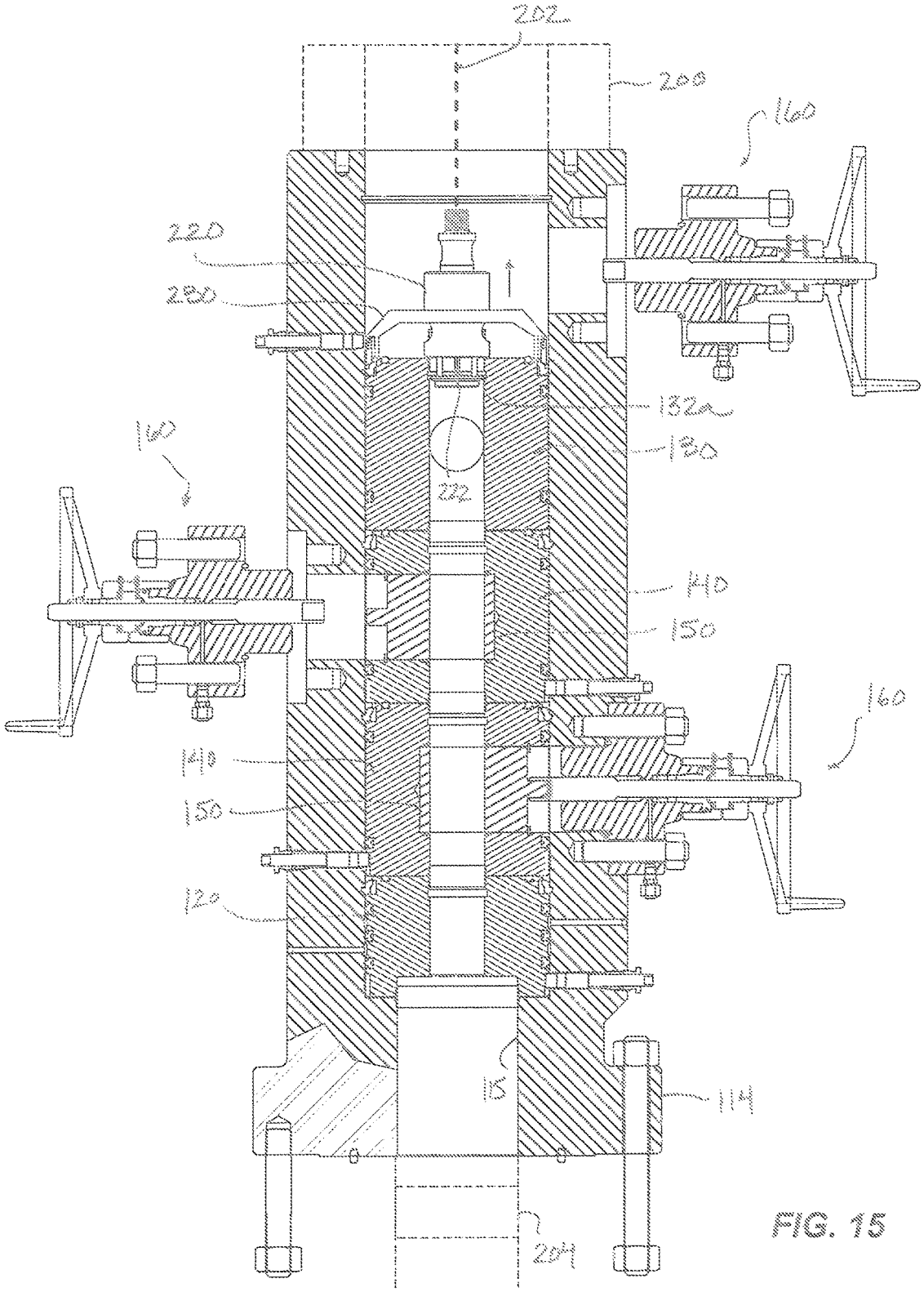
FIG. 15 illustrates the disclosed tree assembly in a stage of disassembly.

When desired, operators can reconfigure the cartridges (120, 130, 140, 170, . . . ) in the housing 110 to meet any desired operational needs. In general, retrieval or reconfiguration of the cartridges (120, 130, 140, 170, . . . ) is the reverse of the installation steps detailed above and shown in FIG. 14A-14G. To change the cartridges as shown in FIG. 15, for example, operators close the valve cartridges 140, remove the top cap 106, and install a Blow Out Preventer (BOP), lubricator, and other necessary components. Then, operators open the valve cartridges 140 and install a plug, such as a back pressure valve 204 to seal the wellbore.

With the well properly sealed off, the bonnets 160 can be removed from the housing 110 so that the stems are free from the valve elements 150. Using wireline 202, operators run a retrieval tool 220 into the housing 110 and connect to the uppermost cartridge (i.e., uppermost valve cartridge 140) to remove it from the housing 110. Similar to the operations discussed previously, the retrieval tool 220 can engage keys 222 in the internal fishing neck profile 142*a* in the cartridge 140 using conventional techniques to be able to lift the cartridge 140 from the housing 110.

The tool 220 also has an unlocking element 230, which can have a ring, a lip, fingers, or other feature. When activated either hydraulically or mechanically, the unlocking element 230 moves the latch ring 148 inward to disengage from the lock profile 118 inside the housing 110. Freed from engagement, the cartridge 140 can then be lifted out of the housing 110.

This process is repeated for each the various cartridges at least until the lower most cartridge to be changed is reached and removed. For example, if the bottom spacer cartridge 120 is to be replaced with a hanger cartridge (170) to support a velocity string (180), the lower most spacer cartridge 120 may be reached and removed.

Operators then install the desired arrangement of cartridges into the housing 110, such as installing the hanger cartridge 170 with velocity string (180) and capillary string (185) and then the other cartridges for the desired arrangement.

If a velocity string (180) or capillary string (185) is to be installed, operator will need to remove the downhole valve 204. Therefore, the various openings in the housing 110, such as the bonnet openings 117, will need to be sealed off with flanged adapters, caps or the like, and a wireline BOP, lubricator, and other components will need to be installed on top of the housing 110 so that the downhole valve 204 can be removed and the hanger cartridge 170 and velocity string 180 can be installed. These and other procedures for modifying, disassembling, and reassembling the assembly 100 for various purposes while containing the wellbore will be evident to one skilled in the art with the benefit of the present disclosure so that particular details are omitted for the sake of brevity.

G. Dual Bore Tree Assembly

Figure 16:
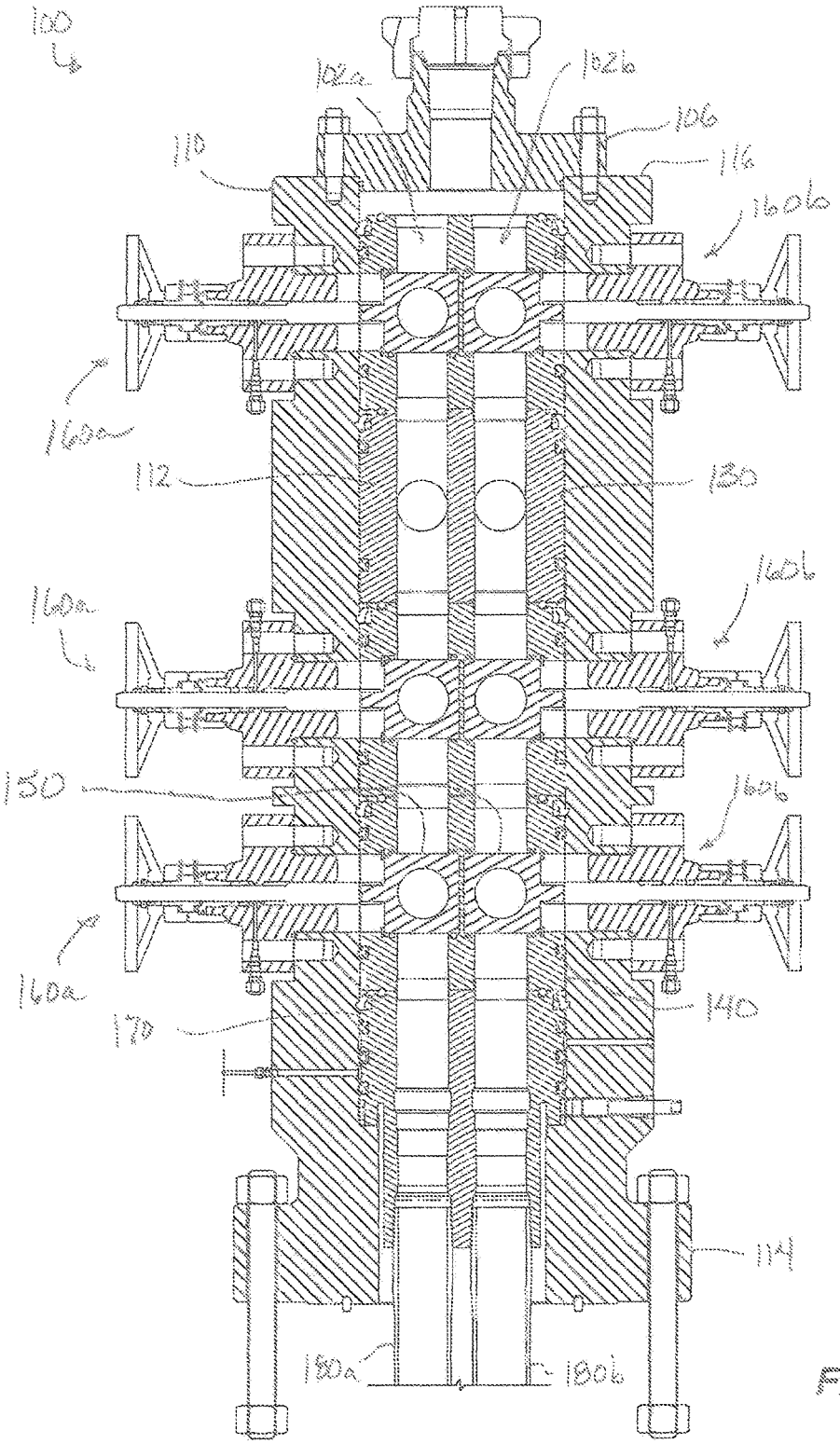
FIG. 16 illustrates a tree assembly according to the present disclosure having dual bores.
Figure 17:
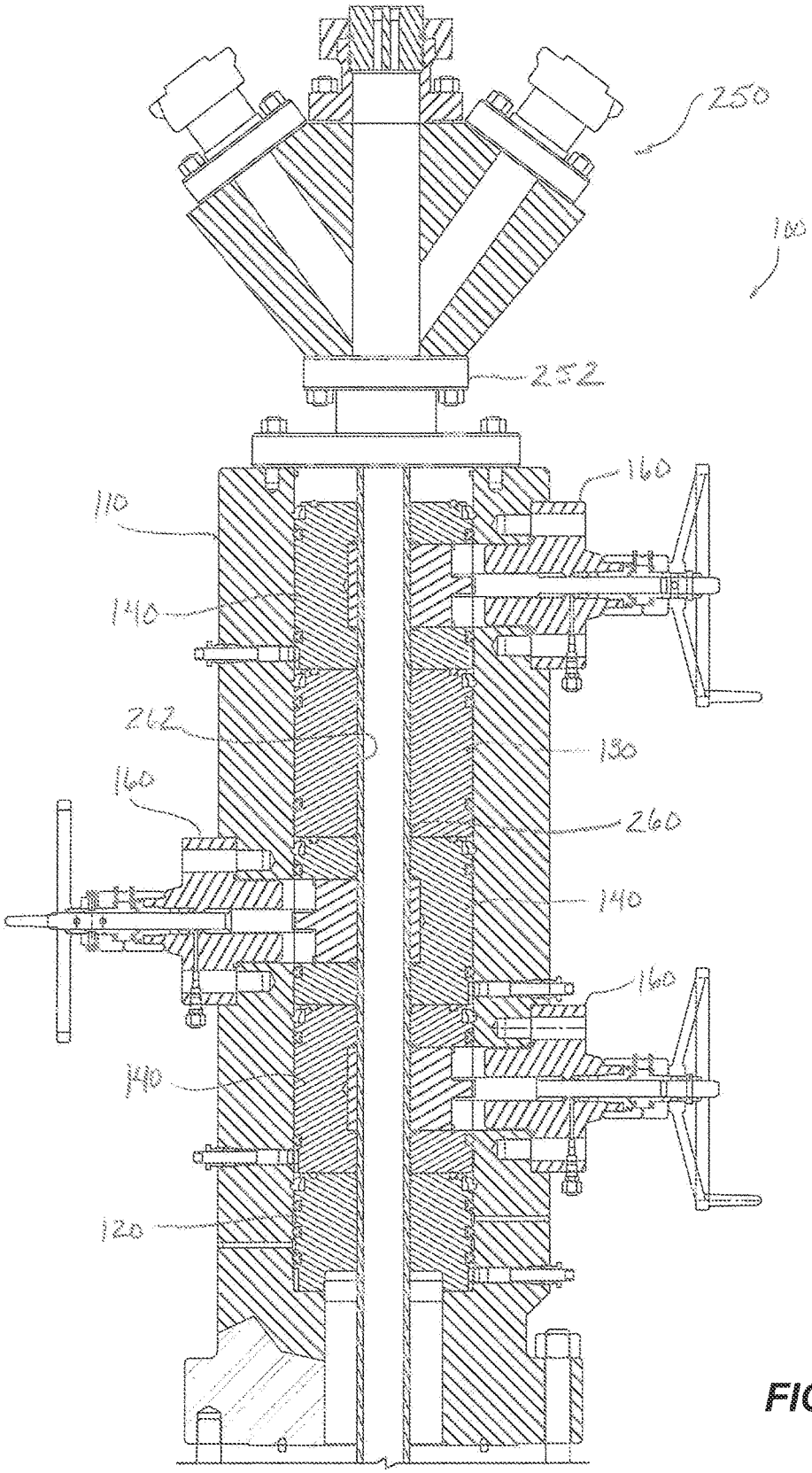
FIG. 17 illustrates a tree assembly according to the present disclosure having a frac head disposed thereon and a removable frac sleeve disposed through the cartridges.

As shown in FIG. 16, the assembly 100 can be configured as a dual bore production tree for multiple strings, such as the dual strings 180*a-b* shown. Accordingly, each of the cartridges (120, 130, 140, 170, . . . ) can define a dual bore 102*a-b*—one for each of the strings 180*a-b*. Notably, the valve cartridges 140 will have dual valve elements 150 being separately actuatable by opposing bonnets 160*a-b*. Depending on the size and arrangement of the assembly 100, any alignment pins (not shown), ports, capillary lines, and other elements used on the housing 110 may be offset or moved to accommodate the arrangement of the various components. Additional bores can also be provided as space allows.

H. Assembly for Drilling, Completion, and Production Operations

Although the assembly 100 has been discussed above for use as a production tree, an assembly 100 having a housing 110 and interchangeable, modular cartridges can be used as part of a wellhead for drilling and completion operations. For drilling, cartridges used in the housing 110 can include tubing hangers and an empty cavity cartridge with a wear sleeve. For completions, a suitable cartridge can have a hanger for the applicable tree configuration (e.g., 2⅜, 2⅞, 4½, etc.). For production, suitable cartridges may be designed for 7-in. frac or other treatment operations to treat the well. These and other types of cartridges can be used for various types of operations using the assembly 100.

For fracing, gravel pack, or other operations, a bore protector or beam can be disposed at least partially in the through-bore 102 of the assembly 100 to protect the internal components. As one example, FIG. 16 shows the assembly 100 of the present disclosure set up for frac or other treatment operations. A treatment fluid applied downhole for these types of operations can be corrosive or damaging to the cartridges (120, 130, 140, etc.). To protect the internal components of the cartridges (120, 130, 140, etc.), the assembly 100 has a protective sleeve 260 that is used during the frac or other treatment operation.

For example, a frac head 250 is shown mounted to the top of the housing 110 with a flanged adapter 252. The sleeve 260 extends down from the frac head 250 or adapter 252 from which it hangs. From there, the sleeve 260 passes through all of the various cartridges (120, 130, 140, etc.), eventually terminating at some point in the wellhead or elsewhere. Of course, all of the valve cartridges 140 are open for the sleeve 260 to pass therethrough.

The sleeve 260 is composed of suitable material and defines a bore 262. During frac or treatment operations, treatment fluid (e.g., a slurry of proppant and carrier fluid) introduced via the frac head 250 travels through the sleeve's bore 262. The sleeve 260 communicates the treatment fluid down through the housing 110 to the other portions of the well without damaging or interacting with the cartridges (120, 130, 140, etc.).

After treatment is complete, the protective sleeve 260 is removed from the through-bore 102 so the assembly 100 can operate for production. The protective sleeve 260 can be used for various types of treatment operations, including fracing, gravel pack, acidizing, and acid fracturing, among others.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Details related to gland nuts, washers, packing, fluid seals, and the like will be apparent to one skilled in the art and are not discussed in detail herein.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A modular Christmas tree assembly for assembly on top of a wellhead to control a well, the assembly comprising:

a wellhead housing mounted on top of the wellhead and defining an internal pocket therein, the internal pocket communicating with the wellhead and having an interior cross-dimension, the internal pocket defining a first side opening communicating outside the wellhead housing;

a plurality of modular cartridges having an exterior cross-dimension less than the interior cross-dimension of the internal pocket, the modular cartridges installed inside the internal pocket of the wellhead housing and interchangeably stacked one on top of another inside the internal pocket of the wellhead housing, the modular cartridges each having a cartridge bore forming a portion of a through-bore of the Christmas tree assembly communicating with the wellhead, the modular cartridges configuring the Christmas tree assembly in an operational arrangement to control the well, wherein at least one first of the modular cartridges comprises a valve cartridge having a valve element contained within the exterior cross-dimension of the valve cartridge and exposed to the at least one first side opening in the wellhead housing, the valve element being movable between open and closed conditions relative to the cartridge bore; and a bonnet removably disposed on the wellhead housing at the first side opening, a portion of the bonnet extending through the first side opening of the wellhead housing and connected to the valve element contained within the exterior cross-dimension of the valve cartridge, the portion of the bonnet being operable to move the valve element between the open and closed conditions relative to the cartridge bore forming the portion of the through-bore.

2. The assembly of claim 1, wherein the wellhead housing has first and second ends, the first end mounted to the head of the wellhead and defining a first end opening of the internal pocket communicating with the wellhead, the second end having a second end opening of the internal pocket through which the modular cartridges install.

3. The assembly of claim 1, wherein the valve element is movably disposed in the valve cartridge relative to the cartridge bore of the valve cartridge, the valve element moved to the closed condition closing fluid communication through the cartridge bore, the valve element moved to the opened condition opening fluid communication through the cartridge bore.

4. The assembly of claim 3, wherein the valve cartridge defines a cross passage communicating the cartridge bore outside the valve cartridge and being exposed to the first side opening, the valve element comprising a body inserted in the cross passage and movably disposed therein, the body defining an orifice therethrough, the body moved to the opened condition aligning the orifice with the cartridge bore, the body moved to the closed condition misaligning the orifice with the cartridge bore.

5. The assembly of claim 4, wherein the body comprises:

a rotatable body rotatably disposed in the cross passage; or a gate slideably disposed in the cross passage.

6. The assembly of claim 4, further comprising seals disposed at interfaces between the body and the cross passage and sealing the cartridge bore from the cross passage.

7. The assembly of claim 1, wherein the valve element comprises a drive head contained within the exterior cross-dimension of the valve cartridge and allowing the valve cartridge to install inside the internal pocket, the portion of the bonnet connecting to the drive head.

8. The assembly of claim 7, wherein the portion of the bonnet comprises a movable stem connecting to the drive head of the valve element contained within the exterior cross-dimension of the valve cartridge.

9. The assembly of claim 1, wherein at least one second of the modular cartridges comprises a cross cartridge defining the cartridge bore and at least one cross passage, the at least one cross passage communicating the cartridge bore outside the cross cartridge.

10. The assembly of claim 9, further comprising a flow component disposed outside the wellhead housing against a second side opening in the wellhead housing, the flow component communicating with the at least one cross passage in the cross cartridge through the second side opening.

11. The assembly of claim 1, wherein at least one second of the modular cartridges comprises a hanger cartridge defining the cartridge bore and having a connection on one end of the cartridge bore supporting tubing from the hanger cartridge.

12. The assembly of claim 1, wherein at least one second of the modular cartridges comprises a hanger cartridge defining a port therein, one end of the port supporting a line, the other end of the port communicating with a port opening in the wellhead housing.

13. The assembly of claim 1, wherein one or more of the modular cartridges comprise a lock disposed on the modular cartridge and engaging inside the internal pocket.

14. The assembly of claim 13, wherein the lock comprises a first shoulder biased to extend beyond exterior cross-dimension of the modular cartridge and engage a second shoulder defined in the internal pocket.

15. The assembly of claim 1, further comprising a plurality of lock screws disposed in the wellhead housing and engaging one or more of the modular cartridges in the internal pocket.

16. The assembly of claim 1, further comprising a plurality of alignment pins disposed in the wellhead housing and engaging in alignment slots on one or more of the modular cartridges in the internal pocket.

17. The assembly of claim 1, further comprising bore seals disposed in cartridge bores of the modular cartridges and sealing interfaces of the cartridge bores between the modular cartridges stacked together.

18. The assembly of claim 1, wherein the modular cartridges define the cartridge bores therethrough aligning with one another when stacked together and configuring an internal dimension of the through-bore bore of the Christmas tree assembly.

19. The assembly of claim 1, wherein the operational arrangement comprises one or more of: a lower master valve, an upper master valve, a swab valve, a cross tee, a capillary hanger, and a tubing hanger.

20. The assembly of claim 1, wherein each of the modular cartridges has a same exterior cross-dimension, and wherein the modular cartridges comprise at least two sets, a first of the at least two sets having the cartridge bores with a first internal dimension, a second of the at least two sets having cartridge bores with a second internal dimension, the modular cartridges of the first set stacked in the wellhead housing configuring the through-bore bore of the Christmas tree assembly with the first internal dimension, the modular cartridges of the second set stacked in the wellhead housing configuring the through-bore bore of the assembly with the second internal dimension.

21. The assembly of claim 1, wherein two or more of the modular cartridges has a same height.

22. The assembly of claim 1, wherein the wellhead housing defines at least one second side opening communicating with the internal pocket, the at least one second side opening configured to communicate with a side passage in at least one of the modular cartridges when stacked in the internal pocket adjacent the at least one second side opening.

23. The assembly of claim 22, further comprising an adapter affixing to the at least one second side opening and sealing communication of the internal pocket outside the wellhead housing.

24. The assembly of claim 1, further comprising a running tool releasably engaging the modular cartridges and stacking the modular cartridges in the internal pocket of the wellhead housing.

25. The assembly of claim 1, further comprising a retrieval tool releasably engaging the modular cartridges and retrieving the modular cartridges from the internal pocket of the wellhead housing.

26. The assembly of claim 25, wherein the retrieval tool releases a lock disposed on the modular cartridges from the internal pocket.

27. The assembly of claim 1, wherein the internal pocket comprises a plurality of first means for locking disposed internally therein; and wherein each of the modular cartridges comprises a second means for locking disposed externally thereon, the second locking means releasably engaging the first locking means.

28. The assembly of claim 1, wherein at least one second of the modular cartridges comprises:

means for passing fluid communication from the through-bore outside the wellhead housing;

means for suspending a capillary in the wellhead and in communication outside the wellhead housing; or means for suspending tubing in the wellhead and in communication with the through-bore of the wellhead housing.

29. The assembly of claim 1, wherein the modular cartridges comprise:

means for sealing inside the internal pocket of the wellhead housing;

means for sealing interfaces between the modular cartridges; or means for aligning in the internal pocket of the wellhead housing.

30. The assembly of claim 1, further comprising means for protecting the modular cartridges from a treatment fluid passed through the through-bore of the Christmas tree assembly.

31. A method of assembling a Christmas tree assembly on top of a wellhead to control a well, the method comprising, not necessarily in order:

mounting a wellhead housing of the Christmas tree assembly on top of the wellhead with an internal pocket of the wellhead housing in fluid communication with the wellhead, the internal pocket having an interior cross-dimension and defining at least one side opening communicating outside the wellhead housing;

configuring a through-bore of the Christmas tree assembly for operation by installing a plurality of modular cartridges from a top of the wellhead housing inside the interior cross-dimension of the internal pocket and stacking the modular cartridges one on top of another in an operational arrangement inside the internal pocket of the wellhead housing, the modular cartridges each having an exterior cross-dimension less than the interior cross-dimension of the internal pocket and each having a cartridge bore forming a portion of a through-bore of the Christmas tree, wherein stacking the modular cartridges comprises stacking, through the internal pocket, at least one valve cartridge having a valve element exposed at the at least one side opening of the wellhead housing and contained within the exterior cross-dimension of the valve cartridge; and connecting external components on the wellhead housing according to the operational arrangement of the modular cartridges stacked in the internal pocket by disposing at least one removable bonnet at the at least one side opening on the wellhead housing and connecting a portion of the bonnet through the at least one side opening to the valve element contained within the exterior cross-dimension of the valve cartridge to move the valve element between the open and closed conditions relative to the cartridge bore forming the portion of the through-bore.

32. The method of claim 31, wherein stacking the modular cartridges in the operational arrangement in the internal pocket of the wellhead housing comprises one or more of: locking the modular cartridges in the internal pocket; sealing the modular cartridges against the internal pocket; and sealing interfaces between the modular cartridges.

33. The method of claim 31, wherein stacking the modular cartridges in the operational arrangement in the internal pocket of the wellhead housing comprises:

stacking a cross cartridge as one of the modular cartridges; and communicating a cross passage of the cartridge bore in the cross cartridge with an external opening in the wellhead housing.

34. The method of claim 33, wherein connecting the external components on the wellhead housing according to the operational arrangement of the modular cartridges stacked in the internal pocket comprises connecting a flow component to the external opening in the wellhead housing.

35. The method of claim 31, wherein stacking the modular cartridges in the operational arrangement in the internal pocket of the wellhead housing comprises:

extending a capillary from a flow port in a hanger cartridge;

stacking the hanger cartridge as one of the modular cartridges in the internal pocket in the wellhead housing; and communicating the flow port in the hanger cartridge with an external opening in the wellhead housing.

36. The method of claim 31, wherein stacking the modular cartridges in the operational arrangement in the internal pocket of the wellhead housing comprises:

extending a string from the cartridge bore in a hanger cartridge;

stacking the hanger cartridge as one of the modular cartridges in the internal pocket in the wellhead housing; and supporting the string from the hanger cartridge stacked in the wellhead housing.

37. The method of claim 31, wherein stacking the at least one valve cartridge comprises:

installing the valve element in a cross passage of the at least one valve cartridge with an exposed end of the valve element disposed within the exterior cross-dimension of the at least one valve cartridge; and stacking the at least one valve cartridge as one of the modular cartridges in the internal pocket with the exposed end disposed within the exterior cross-dimension and with the cross passage exposed to the at least one side opening in the wellhead housing.

38. The method of claim 31, the method further comprising:

extending a sleeve in the through-bore in the Christmas tree assembly; and bypassing interaction of a treatment fluid with the modular cartridges by communicating the treatment fluid through the sleeve.

* * * * *